US006190305B1

(12) United States Patent
Ball et al.

(10) Patent No.: US 6,190,305 B1
(45) **Date of Patent: *Feb. 20, 2001**

(54) IMPLANTABLE AND EXTERNAL HEARING SYSTEMS HAVING A FLOATING MASS TRANSDUCER

(75) Inventors: Geoffrey R. Ball, Sunnyvale; James M. Culp, Woodside; Craig Mar, Fremont; Tim Dietz, Castro Valley; John D. Salisbury, Scotts Valley, all of CA (US)

(73) Assignee: Symphonix Devices, Inc., San Jose, CA (US)

( * ) Notice: Under 35 U.S.C. 154(b), the term of this patent shall be extended for 0 days.

This patent is subject to a terminal disclaimer.

(21) Appl. No.: 09/175,199

(22) Filed: Oct. 20, 1998

Related U.S. Application Data

(63) Continuation of application No. 08/772,779, filed on Dec. 23, 1996, now Pat. No. 5,857,958, which is a continuation-in-part of application No. 08/225,153, filed on Apr. 8, 1994, now Pat. No. 5,554,096, which is a continuation-in-part of application No. 08/087,618, filed on Jul. 1, 1993, now Pat. No. 5,456,654.

(51) Int. Cl.[7] ..... H04R 25/00
(52) U.S. Cl. ..... 600/25; 607/55
(58) Field of Search ..... 600/25; 607/55–57; 381/68–69.2

(56) References Cited

U.S. PATENT DOCUMENTS 4,729,366 * 3/1988 Schaefer ..... 600/25
5,531,787 * 7/1996 Lesinski et al. ..... 600/25
5,624,376 * 4/1997 Ball et al. ..... 600/25

* cited by examiner

*Primary Examiner*—John P. Lacyk
(74) *Attorney, Agent, or Firm*—Townsend and Townsend and Crew LLP

(57) ABSTRACT

A floating mass transducer for improving hearing in a hearing impaired person is provided. The floating mass transducer (100) may be implanted or mounted externally for producing vibrations in a vibratory structure of an ear. In an exemplary embodiment, the floating mass transducer comprises a magnet assembly (12) and a coil (14) secured inside a housing (10) which is fixed to an ossicle of a middle ear. The coil is more rigidly secured to the housing than the magnet. The magnet assembly and coil are configured such that conducting alternating electrical current through the coil results in vibration of the magnet assembly and coil relative to one another. The vibration is caused by the interaction of the magnetic fields of the magnet assembly and coil. Because the coil is more rigidly secured to the housing than the magnet assembly, the vibrations of the coil cause the housing to vibrate. The vibrations of the housing are conducted to the oval window of the ear via the ossicles. In alternate embodiments, the floating mass transducer produces vibrations using piezoelectric materials.

28 Claims, 34 Drawing Sheets

IMPLANTABLE AND EXTERNAL HEARING SYSTEMS HAVING A FLOATING MASS TRANSDUCER

This application is a Continuation of and claims the benefit of U.S. Application of application Ser. No. 08/772,779 filed on Dec. 23, 1996, now U.S. Pat. No. 5,857,958 which is a Continuation-In-Part Application of application Ser. No. 08/225,153 filed on Apr. 8, 1994, now U.S. Pat. No. 5,554,096 which is a Continuation-In-Part Application of application Ser. No. 08/087,618 filed on Jul. 1, 1993 now U.S. Pat. No. 5,456,654. The full disclosures of each of these applications is hereby incorporated by reference for all purposes.

BACKGROUND OF THE INVENTION

The present invention relates to the field of devices and methods for improving hearing in hearing impaired persons and particularly to the field of implantable and external transducers for producing vibration in the middle ear.

A number of auditory system defects are known to impair or prevent hearing. To illustrate such defects, a schematic representation of part of the human auditory system is shown in FIG. 1. The auditory system is generally comprised of an external ear AA, a middle ear JJ, and an internal ear FF. The external ear AA includes the ear canal BB and the tympanic membrane CC, and the internal ear FF includes an oval window EE and a vestibule GG which is a passageway to the cochlea (not shown). The middle ear JJ is positioned between the external ear and the middle ear, and includes an eustachian tube KK and three bones called ossicles DD. The three ossicles DD: the malleus LL, the incus MM, and the stapes HH, are positioned between and connected to the tympanic membrane CC and the oval window EE.

In a person with normal hearing, sound enters the external ear AA where it is slightly amplified by the resonant characteristics of the ear canal BB. The sound waves produce vibrations in the tympanic membrane CC, part of the external ear that is positioned at the distal end of the ear canal BB. The force of these vibrations is magnified by the ossicles DD.

Upon vibration of the ossicles DD, the oval window EE, which is part of the internal ear FF, conducts the vibrations to cochlear fluid (not shown) in the inner ear FF thereby stimulating receptor cells, or hairs, within the cochlea (not shown). Vibrations in the cochlear fluid also conduct vibrations to the round window (not shown). In response to the stimulation, the hairs generate an electrochemical signal which is delivered to the brain via one of the cranial nerves and which causes the brain to perceive sound.

The vibratory structures of the ear include the tympanic membrane, ossicles (malleus, incus, and stapes), oval window, round window, and cochlea. Each of the vibratory structures of the ear vibrates to some degree when a person with normal hearing hears sound waves. However, hearing loss in a person may be evidenced by one or more vibratory structures vibrating less than normal or not at all.

Some patients with hearing loss have ossicles that lack the resiliency necessary to increase the force of vibrations to a level that will adequately stimulate the receptor cells in the cochlea. Other patients have ossicles that are broken, and which therefore do not conduct sound vibrations to the oval window.

Prostheses for ossicular reconstruction are sometimes implanted in patients who have partially or completely broken ossicles. These prostheses are designed to fit snugly between the tympanic membrane CC and the oval window EE or stapes HH. The close fit holds the implants in place, although gelfoam is sometimes packed into the middle ear to guard against loosening. -Two basic forms are available: total ossicular replacement prostheses which are connected between the tympanic membrane CC and the oval window EE; and partial ossicular replacement prostheses which are positioned between the tympanic membrane and the stapes HH. Although these prostheses provide a mechanism by which vibrations may be conducted through the middle ear to the oval window of the inner ear, additional devices are frequently necessary to ensure that vibrations are delivered to the inner ear with sufficient force to produce high quality sound perception.

Various types of hearing aids have been developed to restore or improve hearing for the hearing impaired. With conventional hearing aids, sound is detected by a microphone, amplified using amplification circuitry, and transmitted in the form of acoustical energy by a speaker or another type of transducer into the middle ear by way of the tympanic membrane. Often the acoustical energy delivered by the speaker is detected by the microphone, causing a high-pitched feedback whistle. Moreover, the amplified sound produced by conventional hearing aids normally includes a significant amount of distortion.

Attempts have been made to eliminate the feedback and distortion problems associated with conventional hearing aid systems. These attempts have yielded devices which convert sound waves into electromagnetic fields having the same frequencies as the sound waves. A microphone detects the sound waves, which are both amplified and converted to an electrical current. A coil winding is held stationary by being attached to a nonvibrating structure within the middle ear. The current is delivered to the coil to generate an electromagnetic field. A magnet is attached to an ossicle within the middle ear so that the magnetic field of the magnet interacts with the magnetic field of the coil. The magnet vibrates in response to the interaction of the magnetic fields, causing vibration of the bones of the middle ear.

Existing electromagnetic transducers present several problems. Many are installed using complex surgical procedures which present the usual risks associated with-major surgery and which also require disarticulating (disconnecting) one or more of the bones of the middle ear. Disarticulation deprives the patient of any residual hearing he or she may have had prior to surgery, placing the patient in a worsened position if the implanted device is later found to be ineffective in improving the patient's hearing.

Existing devices also are incapable of producing vibrations in the middle ear which are substantially linear in relation to the current being conducted to the coil. Thus, the sound produced by these devices includes significant distortion because the vibrations conducted to the inner ear do not precisely correspond to the sound waves detected by the microphone.

An improved transducer is therefore needed which will ultimately produce vibrations in the cochlea that have sufficient force to stimulate hearing perception with minimal distortion.

SUMMARY OF THE INVENTION

The present invention provides a floating mass transducer that may be implanted or mounted externally for producing vibrations in vibratory structures of the ear. A floating mass transducer generally includes: a housing mountable on a vibratory structure of an ear; and a mass mechanically coupled to the housing, wherein the mass vibrates in direct response to an externally generated electric signal; whereby vibration of the mass causes inertial vibration of the housing in order to stimulate the vibratory structure of the ear.

In one embodiment, the floating mass transducer includes a magnet disposed inside the housing. The magnet generates a magnetic field and is capable of movement within the housing. A coil is also disposed within the housing but, unlike the magnet, the coil is not free to move within the housing. When an alternating current is provided to the coil, the coil generates a magnetic field that interacts with the magnetic field of the magnet, causing the magnet and coil/housing to vibrate relative-to each other. The vibration of the housing is translated into vibrations of the vibratory structure of the ear to which the housing is mounted.

In another embodiment, the floating mass transducer includes a magnet secured within the housing. A coil is also disposed within the housing but, unlike the magnet, the coil is free to move within the housing. The housing includes a flexible diaphragm or other material to which the coil is attached. When an alternating current is provided to the coil, the coil generates a magnetic field that interacts with the magnetic field of the magnet, causing the magnet/housing and coil/diaphragm to vibrate relative to each other. The vibration of the diaphragm is translated into vibrations of the vibratory structure of the ear to which the housing is mounted.

In still another embodiment, the floating mass transducer includes a bimorph piezoelectric strip disposed within the housing. The piezoelectric strip is secured at one end to the housing and may have a weight attached to the other end. When an alternating current is provided to the piezoelectric strip, the strip vibrates causing the housing and weight to vibrate relative to each other. The vibration of the housing is translated into vibrations of the vibratory structure of the ear to which the housing is mounted.

In another embodiment, the floating mass transducer includes a piezoelectric strip connected externally to the housing. The piezoelectric strip is secured at one end to the housing and may have a weight attached to the other end. When an alternating current is provided to the piezoelectric strip, the strip vibrates causing the housing and weight to vibrate relative to each other. The vibration of the housing is translated into vibrations of the vibratory structure of the ear to which the housing is mounted.

Additional aspects and embodiments of the present invention will become apparent upon a perusal of the following detailed description and accompanying drawings.

DETAILED DESCRIPTION OF THE PREFERRED EMBODIMENTS

CONTENTS

I. GENERAL
II. ELECTROMAGNETIC FLOATING MASS TRANSDUCER
A. Floating Mass Magnet
B. Floating Mass Coil
C. Angular Momentum Mass Magnet
III. PIEZOELECTRIC FLOATING MASS TRANSDUCER
A. Cantilever
B. Thin Membrane
C. Piezoelectric Stack
D. Dual Piezoelectric Strips
IV. EXTERNAL FLOATING MASS TRANSDUCER CONFIGURATION
A. Coupled
B. Non-coupled
C. Concha Plug
V. INTERNAL FLOATING MASS TRANSDUCER CONFIGURATION
A. Middle Ear Attachment Without Disarticulation
B. Total and Partial Ossicular Replacement Prostheses
C. Fully Internal
D. Surgery
VI. EXPERIMENTAL
A. In Vivo Cadaver Examples
B. In Vivo Subjective Evaluation of Speech and Music
VII. CONCLUSION

I. GENERAL

The present invention relates to the field of devices and methods for improving hearing in hearing impaired persons. The present invention provides an improved transducer that may be implanted or mounted externally to transmit vibrations to a vibratory structure of the ear (as defined previously). A "transducer" as used herein is a device which converts energy or information of one physical quantity into another physical quantity. For example, a microphone is a transducer that converts sound waves into electrical impulses.

A transducer according to the present invention will be identified herein as a floating mass transducer (FMT™). A floating mass transducer has a "floating mass" which is a mass that vibrates in direct response to an external signal which corresponds to sound waves. The mass is mechanically coupled to a housing which is mountable on a vibratory structure of the ear. Thus, the mechanical vibration of the floating mass is transformed into a vibration of the vibratory structure allowing the patient to hear. A floating mass transducer can also be utilized as a transducer to transform mechanical vibrations into electrical signals.

In order to understand the present invention, it is necessary to understand the theory upon which the floating mass transducer is based—the conservation of energy principle. The conservation of energy principle states that energy cannot be created or destroyed, but only changed from one form to another. More specifically, the mechanical energy of any system of bodies connected together is conserved (excluding friction). In such a system, if one body loses energy, a connected body gains energy.

Figure 1:
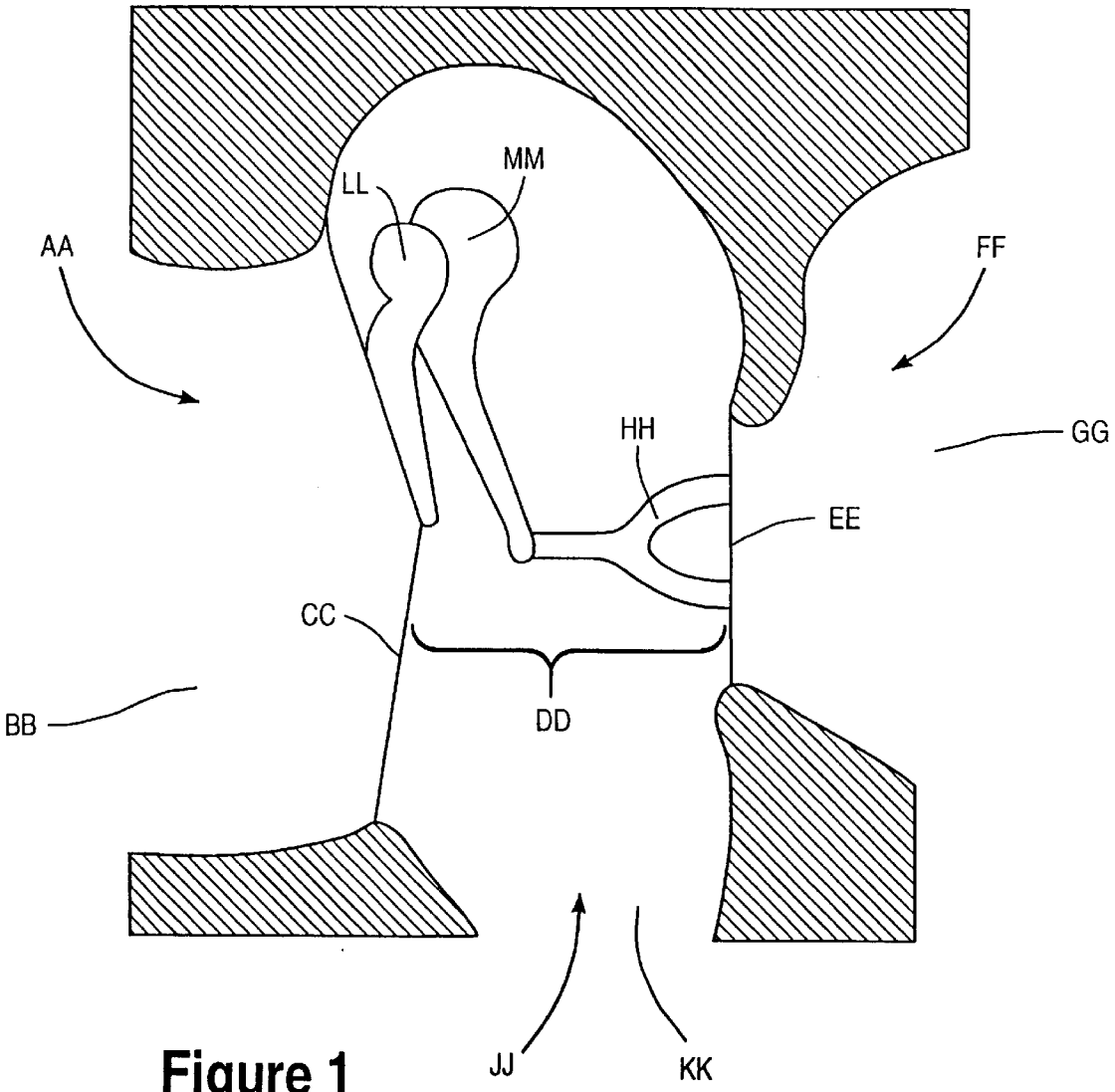
FIG. 1 is a schematic representation of a portion of the human auditory system.
Figure 2B:
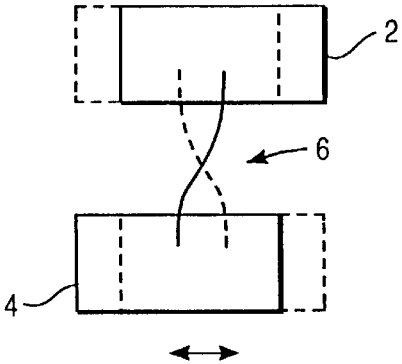
FIG. 2*b* illustrates the counter vibration of a floating mass transducer.
Figure 2C:
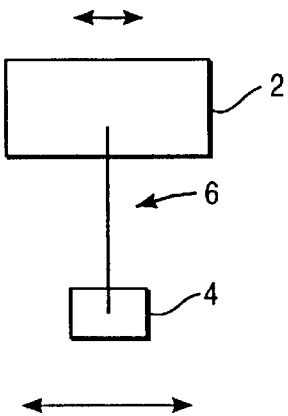
FIGS. 2*c* and 2*d* illustrate the relative vibrations of the floating mass in different configurations.
Figure 2D:
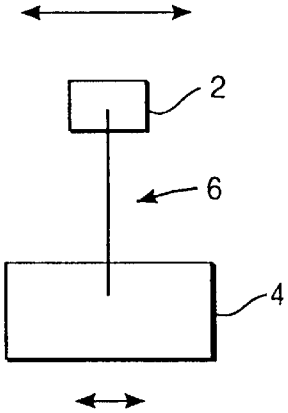
Figure 2A:
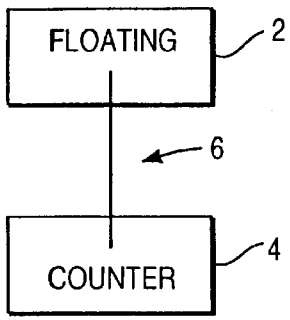
FIG. 2*a* is a conceptual view of a floating mass transducer according to the present invention.

FIG. 2*a* illustrates a conceptual view of a floating mass transducer. A floating block 2 (i.e., the "floating mass") is shown connected to a counter block 4 by a flexible connection 6. The flexible connection is an example of mechanical coupling which allows vibrations of the floating block to be transmitted to the counter block. In operation, a signal corresponding to sound waves causes the floating block to vibrate. As the floating block vibrates, the vibrations are carried through the flexible connection to the counter block. The resulting inertial vibration of the counter block is generally "counter" to the vibration of the floating block. FIG. 2*b* illustrates this counter vibration of the blocks where the double headed arrows represent the relative vibration of each block.

The relative vibration of each of the blocks is generally inversely proportional to the inertia of the block. Thus, the relative vibration of the blocks will be affected by the relative inertia of each block. The inertia of the block can be affected by the mass of the block or other factors (e.g., whether the block is attached to another structure). In this simple example, the inertia of a block will be presumed to be equal to its mass.

FIG. 2*c* illustrates the relative vibration of the blocks where the mass of floating block 2 is greater than the mass of counter block 4. The double headed arrows indicate that the relative vibration of the floating block will be less than the relative vibration of the counter block. In one embodiment that operates according to FIG. 2*c*, a magnet comprises the floating block. The magnet is disposed within a housing such that it is free to vibrate relative to the housing. A coil is secured within the housing to produce vibration of the magnet when an alternating current flows through the coil. Together the housing and coil comprise the counter block and transmit a vibration to the vibratory structure. This embodiment will be discussed more in more detail in reference to FIG. 3.

FIG. 2*d* illustrates the relative vibration of the blocks where the mass of floating block 2 is less than the mass of counter block 4. The double headed arrows indicate that the relative vibration of the floating block will be greater than the relative vibration of the counter block. In one embodiment which operates according to FIG. 2*d*, a coil and diaphragm together comprise the floating block. The diaphragm is a part of a housing and the coil is secured to the diaphragm within the housing. The coil is disposed within a housing such that it is free to vibrate relative to the housing. A magnet is secured within the housing such that the coil vibrates relative to the magnet when an alternating current flows through the coil. Together the housing and magnet comprise the counter block. However, in this embodiment it is the coil and diaphragm (i.e, the floating block) that transmit a vibration to the vibratory structure. This embodiment will be discussed more in more detail in reference to FIGs. 11*a* and 11*b*.

The above discussion is intended to present the basic theory of operation of the floating mass transducer of the present invention. The floating mass transducer is mountable on a vibratory structure of the ear. The floating mass transducer is mountable on a vibratory structure meaning that the transducer is able to transmit vibration to the vibratory structure. Mounting mechanisms include glue, adhesive, velcro, sutures, suction, screws, springs, and the like. For example, the floating mass transducer may be attached to an ossicle within the middle ear by use of a clip. However, the floating mass transducer may also be mounted externally to produce vibrations on the tympanic membrane. For example, the floating mass transducer may be attached to the tympanic membrane by an adhesive. The following is a general discussion of a specific embodiment of a floating mass transducer.

One embodiment of a floating mass transducer comprises a magnet assembly and a coil secured inside a housing which will usually be sealed, particularly for implantable devices where openings might increase the risk of infection. For implantable configurations, the housing is proportioned to be affixed to an ossicle within the middle ear. While the present invention is not limited by the shape of the housing, it is preferred that the housing is of a cylindrical capsule shape. Similarly, it is not intended that the invention be limited by the composition of the housing. In general, it is preferred that the housing is composed of, and/or coated with, a biocompatible material.

The housing contains both the coil and the magnet assembly. Typically, the magnet assembly is positioned in such a manner that it can oscillate freely without colliding with either the coil or the interior of the housing itself. When properly positioned, a permanent magnet within the assembly produces a predominantly uniform flux field. Although this embodiment of the invention involves use of permanent magnets, electromagnets may also be used.

Various components are involved in delivering the signal derived from externally-generated sound to the coil affixed within the middle ear housing. First, an external sound transducer similar to a conventional hearing aid transducer is positioned on the skin or skull. This external transducer processes the sound and transmits a signal, by means of magnetic induction, to a subcutaneous coil transducer. From a coil located within the subcutaneous transducer, alternating current is conducted by a pair of leads to the coil of the transducer implanted within the middle ear. That coil is more rigidly affixed to the housing's interior wall than is the magnet also located therein.

When the alternating current is delivered to the middle ear housing, attractive and repulsive forces are generated by the interaction between the magnet and the coil. Because the coil is more rigidly attached to the housing than the magnet assembly, the coil and housing move together as a unit as a result of the forces produced. The vibrating transducer triggers sound perception of the highest quality when the relationship between the housing's displacement and the coil's current is substantially linear. Such linearity is best achieved by positioning and maintaining the coil within the substantially uniform flux field produced by the magnet assembly.

For the transducer to operate effectively, it must vibrate the ossicles with enough force to transfer the vibrations to the cochlear fluid within the inner ear. The force of the vibrations created by the transducer can be optimized by maximizing both the mass of the magnet assembly relative to the combined mass of the coil and the housing, and the energy product (EP) of the permanent magnet.

Floating mass transducers according to the present invention may be mounted to any of the vibratory structures of the ear. Preferably, the transducer is attached or disposed in these locations such that the transducer is prevented from contacting bone or tissue, which would absorb the mechanical energy it produces. When the transducer is attached to the ossicles, a biocompatible clip may be used. However, in an alternate transducer design, the-housing contains an opening that results in it being annular in shape allowing the housing to be positioned around the stapes or the incus. In other implementations, the transducer is attached to total or partial ossicular replacement prostheses. In still other implementations the transducer is used in an external hearing device.

II. ELECTROMAGNETIC FLOATING MASS TRANSDUCER

It is commonly known that a magnet generates a magnetic field. A coil that has a current flowing through it also generates a magnetic field. When the magnet is placed in close proximity to the coil and an alternating current flows through the coil, the interaction of the respective magnetic fields cause the magnet and coil to vibrate relative to each other. This property of the magnetic fields of magnets and coils provides the basis for floating mass transducers as follows.

A. Floating Mass Magnet

Figure 3:
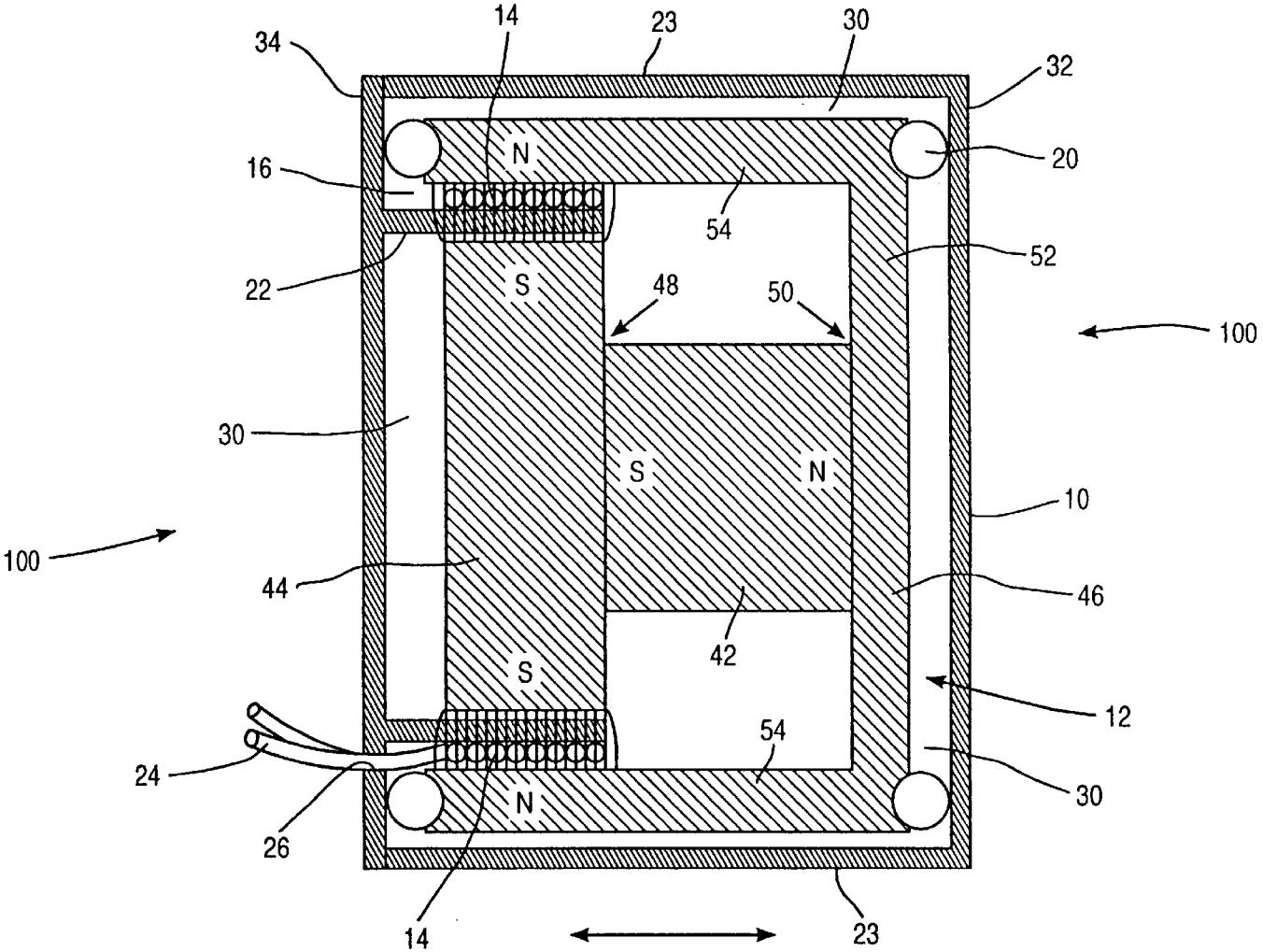
FIG. 3 is a cross-sectional view of an embodiment of a floating mass transducer having a floating magnet.
Figure 4:
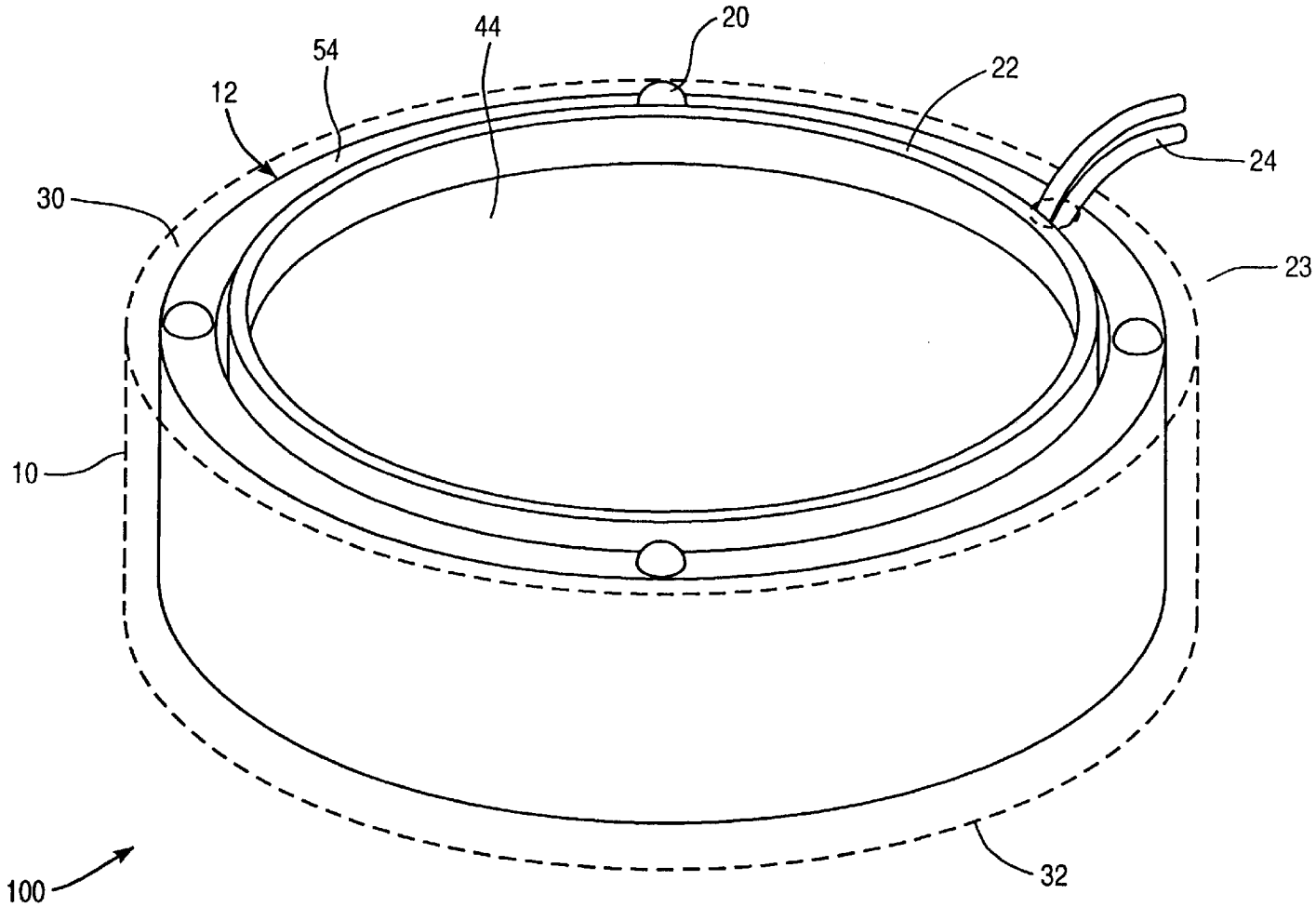
FIG. 4 is a partial perspective view of a floating mass transducer having a floating magnet.

The structure of one embodiment of a floating mass transducer according to the present invention is shown in FIGS. 3 and 4. In this embodiment, the floating mass is a magnet. The transducer 100 is generally comprised of a sealed housing 10 having a magnet assembly 12 and a coil 14 disposed inside it. The magnet assembly is loosely suspended within the housing, and the coil is rigidly secured to the housing. As will be described, the magnet assembly 12 preferably includes a permanent magnet 42 and associated pole pieces 44 and 46. When alternating current is conducted to the coil, the coil and magnet assembly oscillate relative to each other and cause the housing to vibrate. The housing 10 is proportioned to be attached within the middle ear, which includes the malleus, incus, and stapes, collectively known as the ossicles, and the region surrounding the ossicles. The exemplary housing is preferably a cylindrical capsule having a diameter of 1 mm and a thickness of 1 mm, and is made from a biocompatible material such as titanium. The housing has first and second faces 32, 34 that are substantially parallel to one another and an outer wall 23 which is substantially perpendicular to the faces 32, 34. Affixed to the interior of the housing is an interior wall 22 which defines a circular region and which runs substantially parallel to the outer wall 23.

The magnet assembly 12 and coil 14 are sealed inside the housing. Air spaces 30 surround the magnet assembly so as to separate it from the interior of the housing and to allow it to oscillate freely without colliding with the coil or housing. The magnet assembly is connected to the interior of the housing by flexible membranes such as silicone buttons 20. The magnet assembly may alternatively be floated on a gelatinous medium such as silicon gel which fills the air spaces in the housing. A substantially uniform flux field is produced by configuring the magnet assembly as shown in FIG. 3. The assembly includes a permanent magnet 42 positioned with ends 48, 50 containing the south and north poles substantially parallel to the circular faces 34, 32 of the housing. A first cylindrical pole piece 44 is connected to the end 48 containing the south pole of the magnet and a second pole piece 46 is connected to the end 50 containing the north pole. The first pole piece 44 is oriented with its circular faces substantially parallel to the circular faces 32, 34 of the housing 10. The second pole piece 46 has a circular face which has a rectangular cross-section and which is substantially parallel to the circular faces 32, 34 of the housing. The second pole piece 46 additionally has a pair of walls 54 which are parallel to the wall 23 of the housing and which surrounds the first pole piece 44 and the permanent magnet 42.

The pole pieces should be manufactured out of a magnetic material such as ferrite or SmCo. They provide a path for the magnetic flux of the permanent magnet 42 which is less resistive than the air surrounding the permanent magnet 42. The pole pieces conduct much of the magnetic flux and thus cause it to pass from the second pole piece 46 to the first pole piece 44 at the gap in which the coil 14 is positioned.

For the device to operate properly, it should vibrate a vibratory structure with sufficient force such that the vibrations are perceived as sound waves. The force of vibrations are best maximized by optimizing two parameters: the mass of the magnet assembly relative to the combined-mass of the coil and housing, and the energy product (EP) of the permanent magnet 42.

The ratio of the mass of the magnet assembly to the combined mass of the magnet assembly, coil and housing is most easily optimized by constructing the housing of a thinly machined, lightweight material such as titanium and by configuring the magnet assembly to fill a large portion of the space inside the housing, although there must be adequate spacing between the magnet assembly and the housing and coil for the magnet assembly to vibrate freely within the housing.

The magnet should preferably have a high energy product. NdFeB magnets having energy products of forty-five and SmCo magnets having energy products of thirty-two are presently available. A high energy product maximizes the attraction and repulsion between the magnetic fields of the coil and magnet assembly and thereby maximizes the force of the oscillations of the transducer. Although it is preferable to use permanent magnets, electromagnets may also be used in carrying out the present invention.

The coil 14 partially encircles the magnet assembly 12 and is fixed to the interior wall 22 of the housing 10 such that the coil is more rigidly fixed to the housing than the magnet assembly. Air spaces separate the coil from the magnet assembly. In one implementation where the transducer is implanted, a pair of leads 24 are connected to the coil and pass through an opening 26 in the housing to the exterior of the transducer, through the surgically created channel in the temporal bone (indicated as CT in FIG. 10), and attach to a subcutaneous coil 28. The subcutaneous coil 28, which is preferably implanted beneath the skin behind the ear, delivers alternating current to the coil 14 via the leads 24. The opening 26 is closed around the leads 24 to form a seal (not shown) which prevents contaminants from entering the transducer.

The perception of sound which the vibrating transducer ultimately triggers is of the highest quality when the relationship between the displacement of the housing 10 and the current in the coil 14 is substantially linear. For the relationship to be linear, there must be a corresponding displacement of the housing for each current value reached by the alternating current in the coil. Linearity is most closely approached by positioning and maintaining the coil within the substantially uniform flux field 16 produced by the magnet assembly.

When the magnet assembly, coil, and housing are configured as in FIG. 3, alternating current in the coil causes the housing to oscillate side-to-side in the directions indicated by the double headed arrow in FIG. 3. FIG. 4 is a partial perspective view of the transducer of FIG. 3. The transducer is most efficient when positioned such that the side-to-side movement of the housing produces side-to-side movement of the oval window EE as indicated by the double headed arrow in FIG. 5*a*.

Figure 5A:
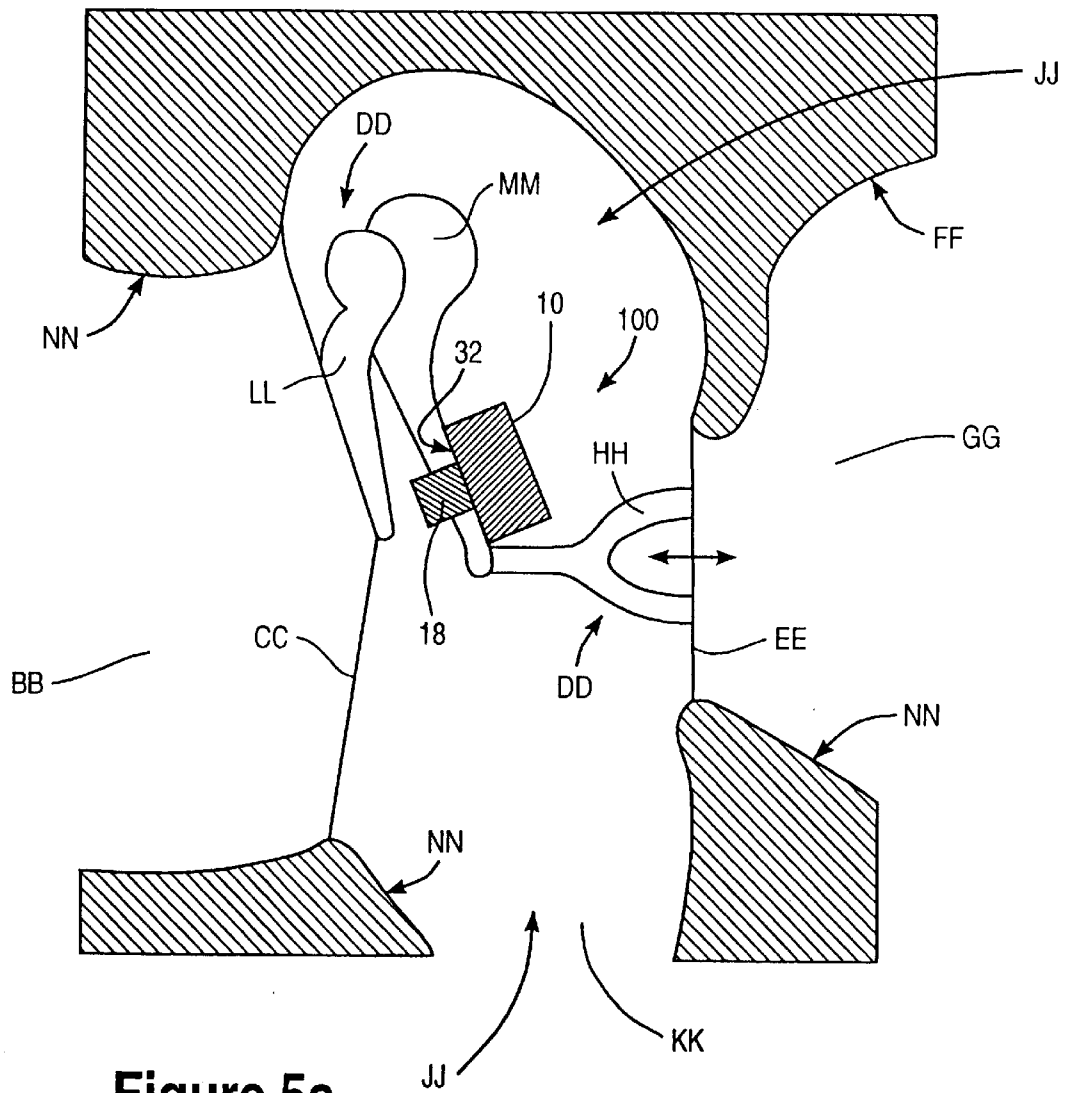
FIG. 5*a* is a schematic representation of a portion of the human auditory system showing a floating mass transducer connected to an incus of the middle ear.
Figure 5B:
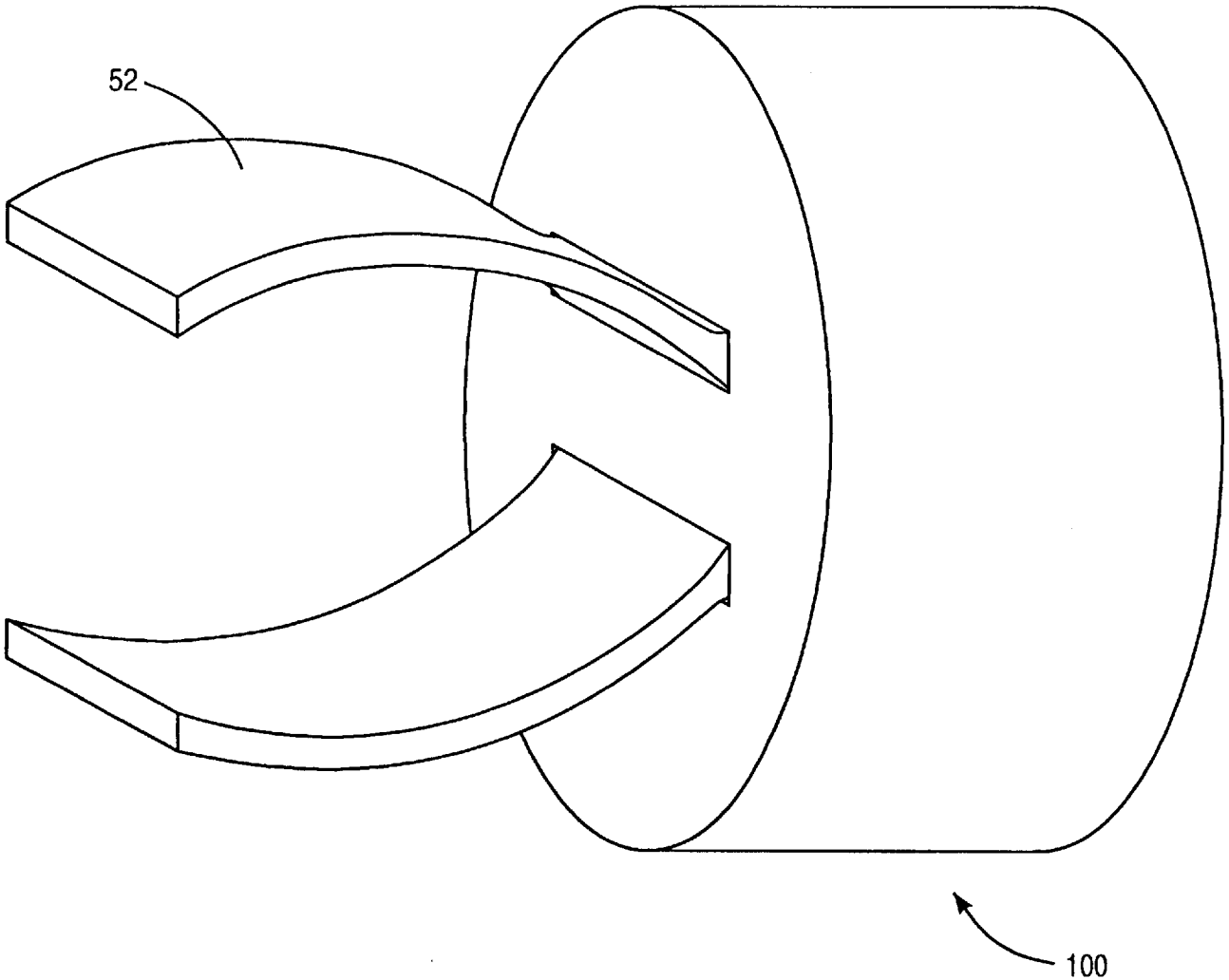
FIG. 5*b* is a perspective view of the floating mass transducer of FIG. 5*a*.

The transducer may be affixed to various structures within the ear. FIG. 5*a* shows a transducer 100 attached to an incus MM by a biocompatible clip 18 which is secured to one of the circular faces 32 of the housing 10 and which at least partially surrounds the incus MM. The clip 18 holds the transducer firmly to the incus so that the vibrations of the housing which are generated during operation are conducted along the bones of the middle ear to the oval window EE of the inner ear and ultimately to the cochlear fluid as described above. An exemplary clip 18, shown in FIG. 5*b*, includes two pairs of titanium prongs 52 which have a substantially arcuate shape and which may be crimped tightly around the incus.

The transducer 100 may be connected to any of the vibratory structures of the ear. The transducer should be mechanically isolated from the bone and tissue in the surrounding region since these structures will tend to absorb the mechanical energy produced by the transducer. For the purposes of this description, the surrounding region consists of all structures in and surrounding the external, middle, and internal ear that are not the vibratory structures of the ear.

Figure 6:
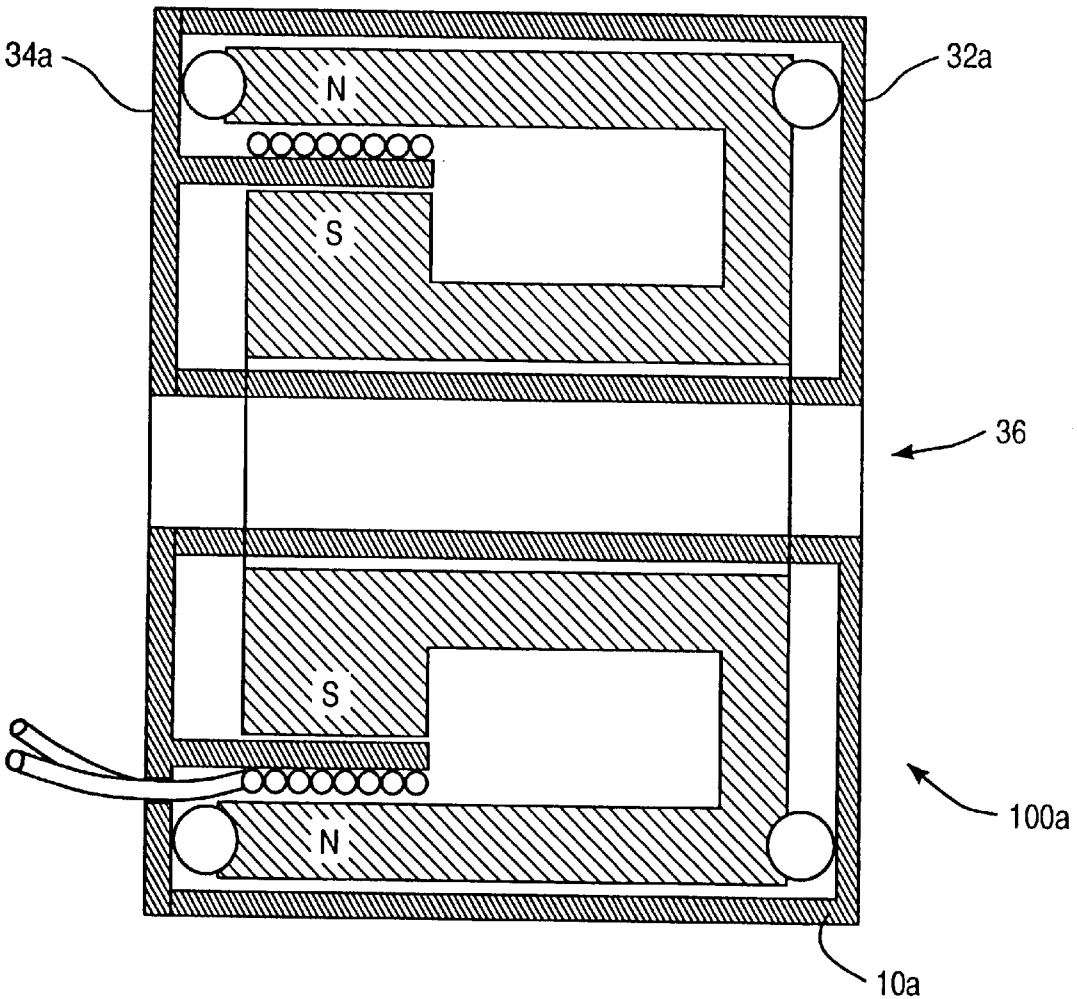
FIG. 6 is a cross-sectional side view of another embodiment of a floating mass transducer having a floating magnet.
Figure 7:
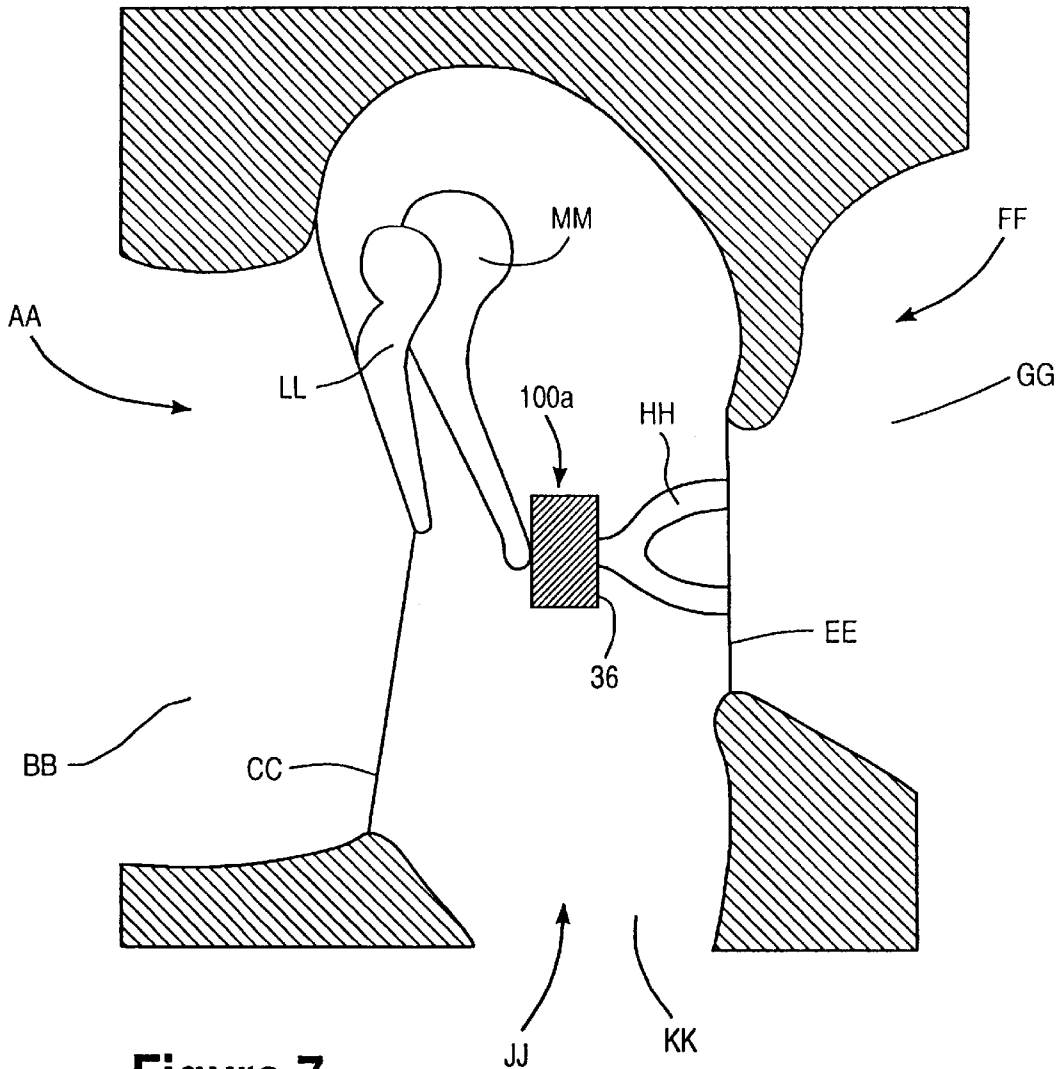
FIG. 7 is a schematic representation of a portion of the auditory system showing the embodiment of FIG. 6 positioned around a portion of a stapes of the middle ear.

An alternate transducer 100*a* having an alternate mechanism for fixing the transducer to structures within the ear is shown in FIG. 6 and 7. In this alternate transducer 100*a*, the housing loa has an opening 36 passing from the first face 32*a* to the second face 34*a* of the housing and is thereby annularly shaped. When implanted, a portion of the stapes HH is positioned within the opening 36. This is accomplished by separating the stapes HH from the incus MM and slipping the O-shaped transducer around the stapes HH. The separated ossicles are then returned to their natural position and where the connective tissue between them heals and causes them to reconnect. This embodiment may be secured around the incus in a similar fashion.

Figure 8:
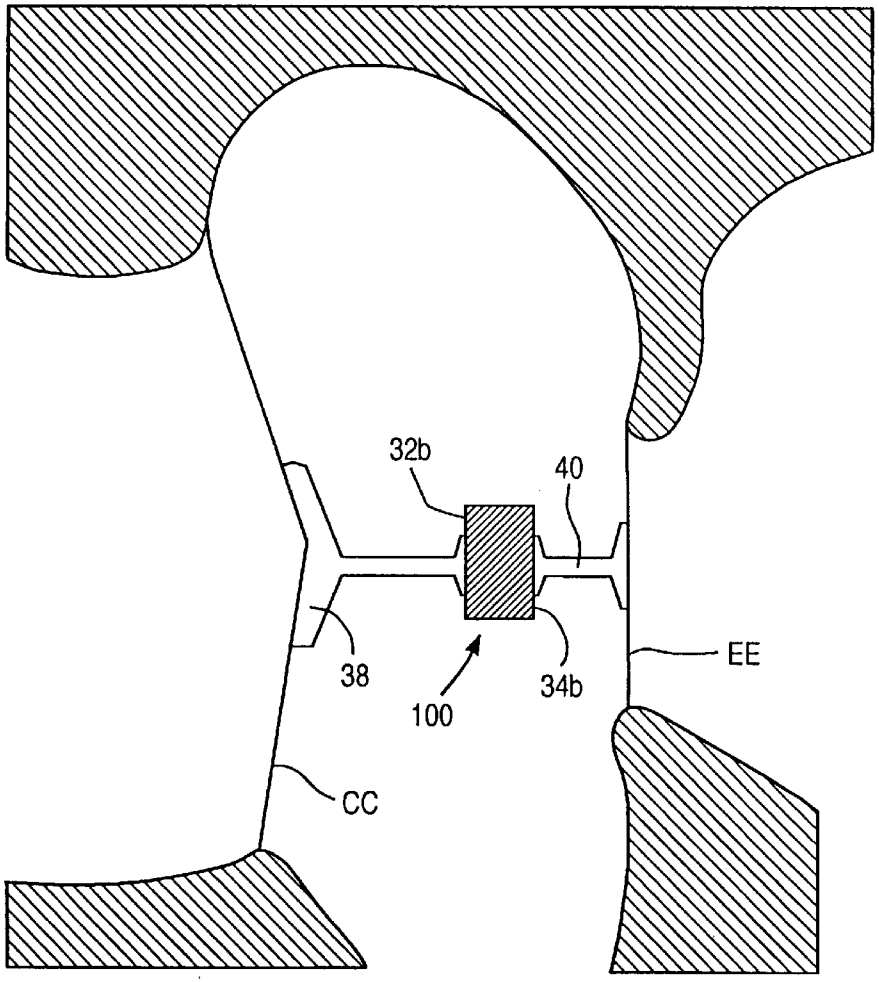
FIG. 8 is a schematic representation of a portion of the auditory system showing a floating mass transducer and a total ossicular replacement prosthesis secured within the ear.
Figure 9:
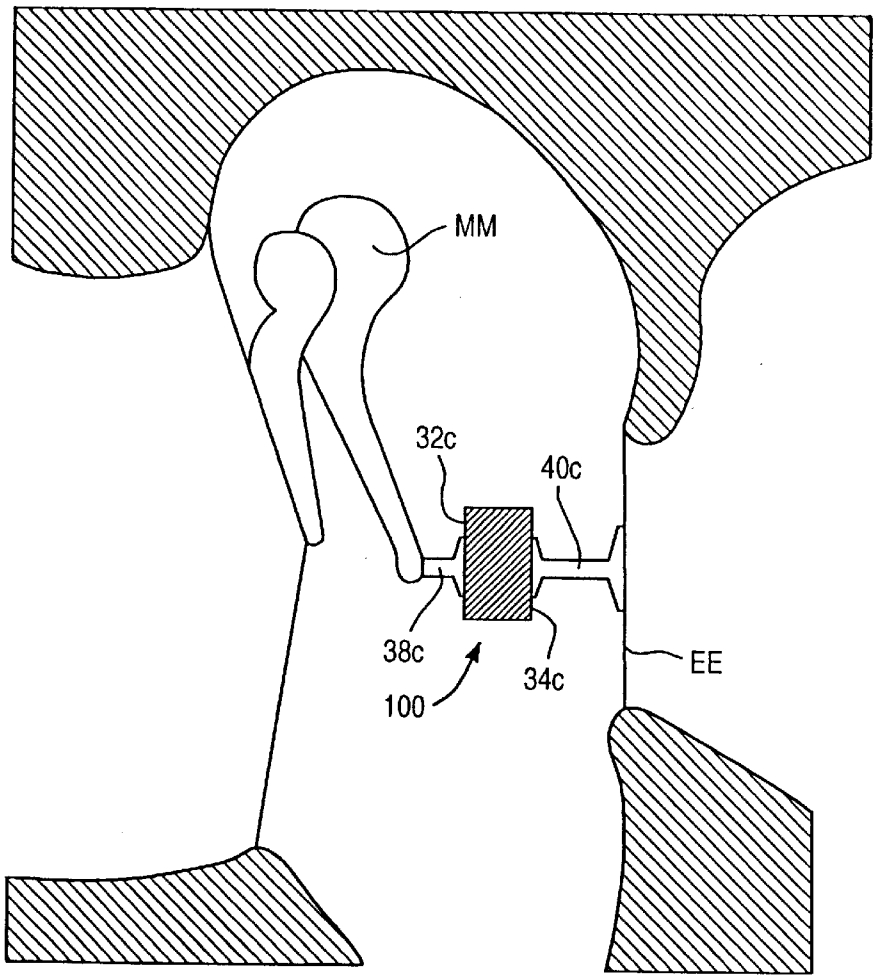
FIG. 9 is a schematic representation of a portion of the auditory system showing a floating mass transducer and a partial ossicular replacement prosthesis secured within the ear.

FIGS. 8 and 9 illustrate the use of the transducer of the present invention in combination with total ossicular replacement prostheses and partial ossicular replacement prostheses. These illustrations are merely representative; other designs incorporating the transducer into ossicular replacement prostheses may be easily envisioned.

Ossicular replacement prostheses are constructed from biocompatible materials such as titanium. Often during ossicular reconstruction surgery the ossicular replacement prostheses are formed in the operating room as needed to accomplish the reconstruction. As shown in FIG. 8, a total ossicular replacement prosthesis may be comprised of a pair of members 38, 40 connected to the circular faces 32*b*, 34*b* of the transducer 100. The prosthesis is positioned between the tympanic membrane CC and the oval window EE and is preferably of sufficient length to be held into place by friction. Referring to FIG. 9, a partial ossicular replacement prosthesis may be comprised of a pair of members 38*c*, 40*c* connected to the circular faces 32*c*, 34*c* of the transducer and positioned between the incus MM and the oval window EE.

Figure 10:
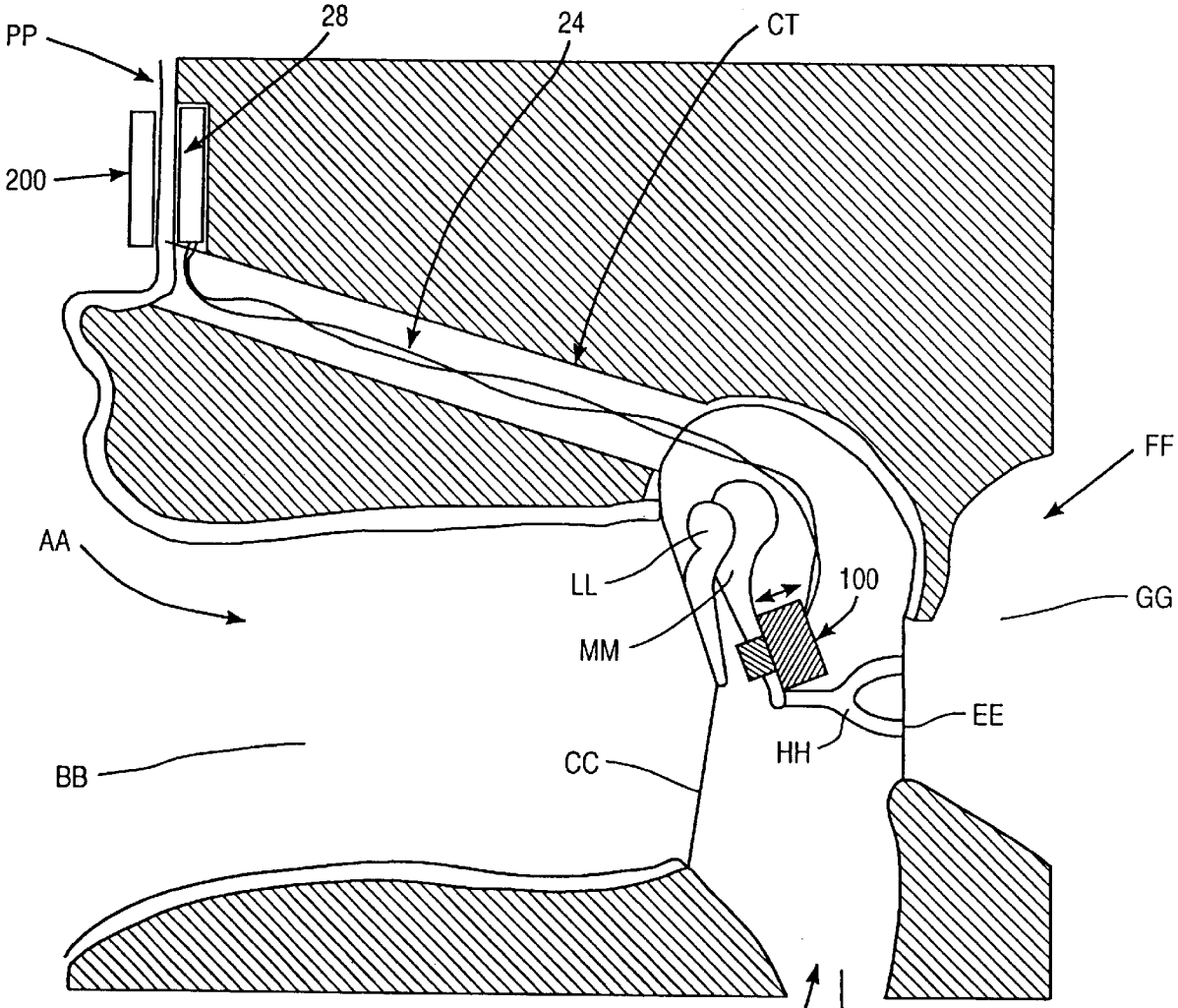
FIG. 10 is a schematic representation of a portion of the auditory system showing a floating mass transducer positioned for receiving alternating current from a subcutaneous coil inductively coupled to an external sound transducer positioned outside a patient's head.

FIG. 10 shows a schematic representation of a transducer 100 and related components positioned within a patient's skull PP. An external sound transducer 200, is substantially identical in design to a conventional hearing aid transducer and is comprised of a microphone, sound processing unit, amplifier, battery, and external coil, none of which are depicted in detail. The external sound transducer 200 is positioned on the exterior of the skull PP. A subcutaneous coil transducer 28 is connected to the leads 24 of the transducer 100 and is typically positioned under the skin behind the ear such that the external coil is positioned directly over the location of the subcutaneous coil 28.

Sound waves are converted to an electrical signal by the microphone and sound processor of the external sound transducer 200. The amplifier boosts the signal and delivers it to the external coil which subsequently delivers the signal to the subcutaneous coil 28 by magnetic induction. Leads 24 conduct the signal to transducer 100 through a surgically created channel CT in the temporal bone. When the alternating current signal representing the sound wave is delivered to the coil 14 in the implantable transducer 100, the magnetic field produced by the coil interacts with the magnetic field of the magnet assembly 12.

As the current alternates, the magnet assembly and the coil alternatingly attract and repel one another. The alternating attractive and repulsive forces cause the magnet assembly and the coil to alternatingly move towards and away from each other. Because the coil is more rigidly attached to the housing than is the magnet assembly, the coil and housing move together as a single unit. The directions of the alternating movement of the housing are indicated by the double headed arrow in FIG. 10. The vibrations are conducted via the stapes HH to the oval window EE and ultimately to the cochlear fluid.

B. Floating Mass Coil

Figure 11B:
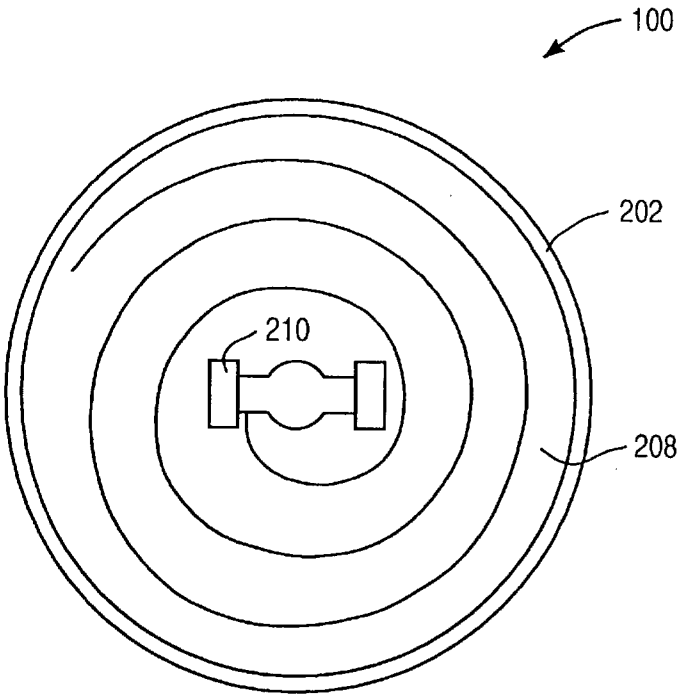
FIG. 11*b* is a side view of the floating mass transducer of FIG. 11*a*.
Figure 11A:
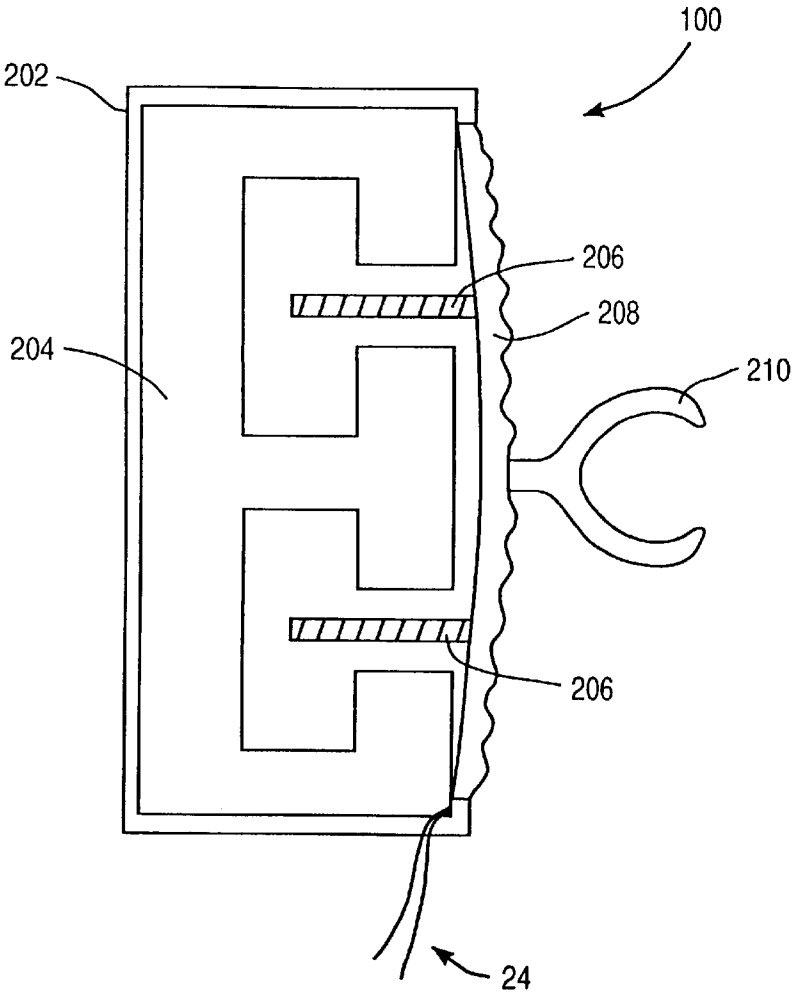
FIG. 11*a* is a cross-sectional view of an embodiment of a floating mass transducer having a floating coil.

The structure of another embodiment of a floating mass transducer according to the present invention is shown in FIGS. 11*a* and 11*b*. Unlike the previous embodiment, the floating mass in this embodiment is the coil. The transducer 100 is generally comprised of a housing 202 having a magnet assembly 204 and a coil 206 disposed inside it. The housing is generally a cylindrical capsule with one end open which is sealed by a flexible diaphragm 208. The magnet assembly may include a permanent magnet and associated pole pieces to produce a substantially uniform flux field as was described previously in reference to FIG. 3. The magnet assembly is secured to the housing, and the coil is secured to flexible diaphragm 208. The diaphragm is shown having a clip 210 attached to center of the diaphragm which allows the transducer to be attached to the incus MM as shown in FIG. 5*a*.

The coil is electrically connected to an external power source (not shown) which provides alternating current to the coil through leads 24. When alternating current is conducted to the coil, the coil and magnet assembly oscillate relative to each other causing the diaphragm to vibrate. Preferably, the relative vibration of the coil and diaphragm is substantially greater than the vibration of the magnet assembly and housing.

For the device to operate properly, it must vibrate a vibratory structure with sufficient force such that the vibrations are perceived as sound waves. The force of vibrations are best maximized by optimizing two parameters: the combined mass of the magnet assembly and housing relative to the combined mass of the coil and diaphragm, and the energy product (EP) of the magnet.

The ratio of the combined mass of the magnet assembly and housing to the combined mass of the coil and diaphragm is most easily optimized by constructing the diaphragm of a lightweight flexible material like mylar. The housing should be a biocompatible material like titanium. The magnet should preferably have a high energy product. A high energy product maximizes the attraction and repulsion between the magnetic fields of the coil and magnet assembly and thereby maximizes the force of the oscillations produced by the transducer. Although it is preferable to use permanent magnets, electromagnets may also be used in carrying out the present invention.

C. Angular Momentum Mass Magnet

Figure 12:
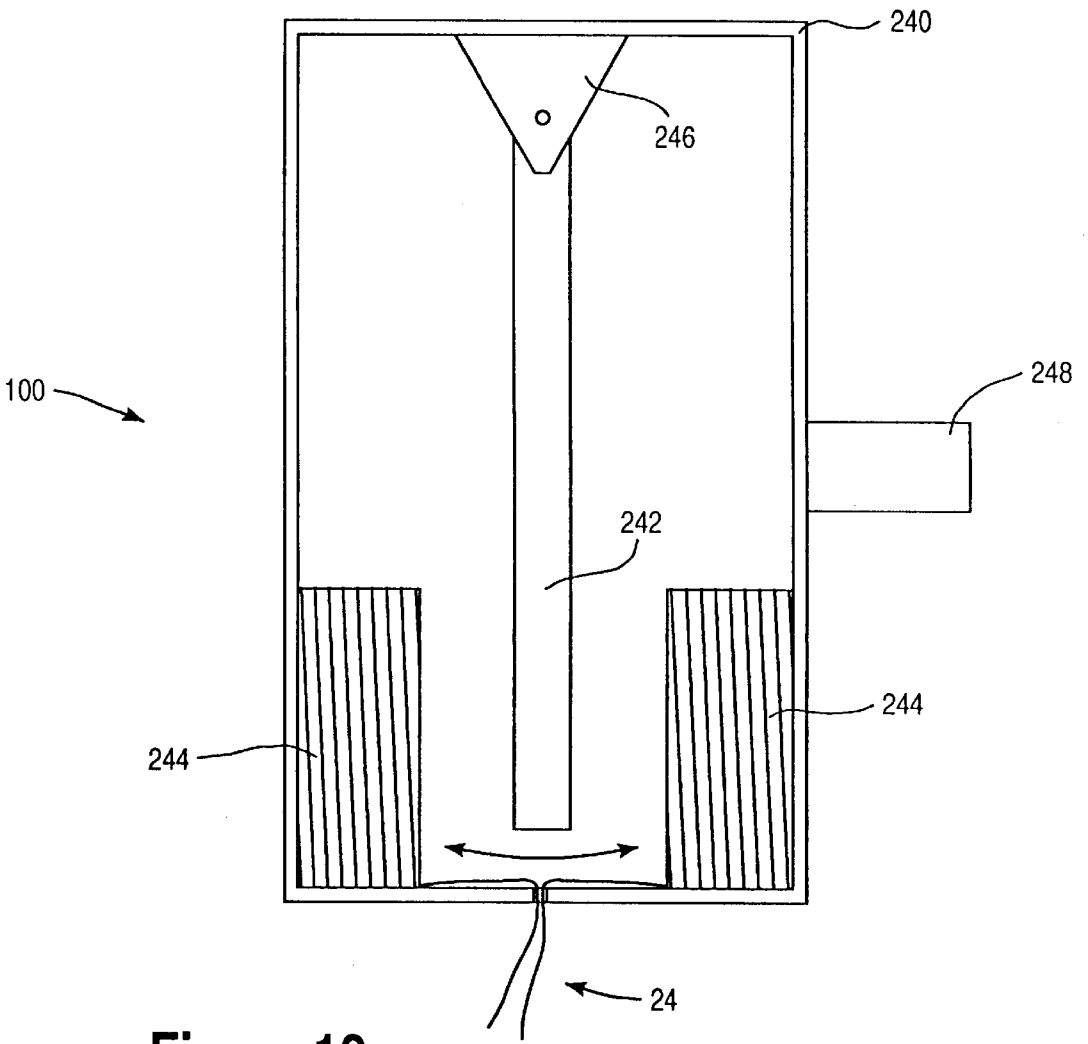
FIG. 12 is a cross-sectional view of an embodiment of a floating mass transducer having a angular momentum mass magnet.

The structure of another embodiment of a floating mass transducer according to the present invention is shown in FIG. 12. In this embodiment, the mass swings like a pendulum through an arc. The transducer 100 is generally comprised of a housing 240 having a magnet 242 and coils 244 disposed inside it. The housing is generally a sealed rectangular capsule. The magnet is secured to the housing by being rotatably attached to a support 246. The support is secured to the inside of the housing and allows the magnet to swing about an axis within the housing. Coils 244 are secured within the housing.

The coils are electrically connected to an external power source (not shown) which provides alternating current to the coils through leads 24. When current is conducted to the coils, one coil creates a magnetic field that attracts magnet 242 while the other coil creates a magnetic field that repels magnet 242. An alternating current will cause the magnet to vibrate relative to the coil and housing. A clip 248 is shown that may be used to attach the housing to an ossicle. Preferably, the relative vibration of the coils and housing is substantially greater than the vibration of the magnet.

For the device to operate properly, it must vibrate a vibratory structure with sufficient force such that the vibrations are perceived as sound waves. The force of vibrations are best maximized by optimizing two parameters: the mass of the magnet relative to the combined mass of the coils and housing, and the energy product (EP) of the magnet.

The ratio of the mass of the magnet to the combined mass of the coils and housing is most easily optimized by constructing the housing of a thinly machined, lightweight material such as titanium and by configuring the magnet to fill a large portion of the space inside the housing, although there must be adequate spacing between the magnet and the coils for the magnet to swing or vibrate freely within the housing.

The magnet should preferably have a high energy product. A high energy product maximizes the attraction and repulsion between the magnetic fields of the magnet and coils and thereby maximizes the force of the oscillations of the transducer. Although it is preferable to use permanent magnets, electromagnets may also be used in carrying out the present invention.

III. PIEZOELECTRIC FLOATING MASS TRANSDUCER

Piezoelectric electricity results from the application of mechanical pressure on a dielectric crystal. Conversely, an application of a voltage between certain faces of a dielectric crystal produces a mechanical distortion of the crystal. This reciprocal relationship is called the piezoelectric effect. Piezoelectric materials include quartz, polyvinylidene fluoride (PVDF), lead titanate zirconate ($PB[ZrTi]O_3$), and the like. A piezoelectric material may also be formed as a bimorph which is formed by binding together two piezoelectric layers with diverse polarities. When a voltage of one polarity is applied to one bimorph layer and a voltage of opposite polarity is applied to the other bimorph layer, one layer contracts while the other layer expands. Thus, the bimorph bends towards the contracting layer. If the polarities of the voltages are reversed, the bimorph will bend in the opposite direction. The properties of piezoelectrics and bimorph piezoelectrics provide the basis for floating mass transducers as follows.

A. Cantilever

Figure 13:
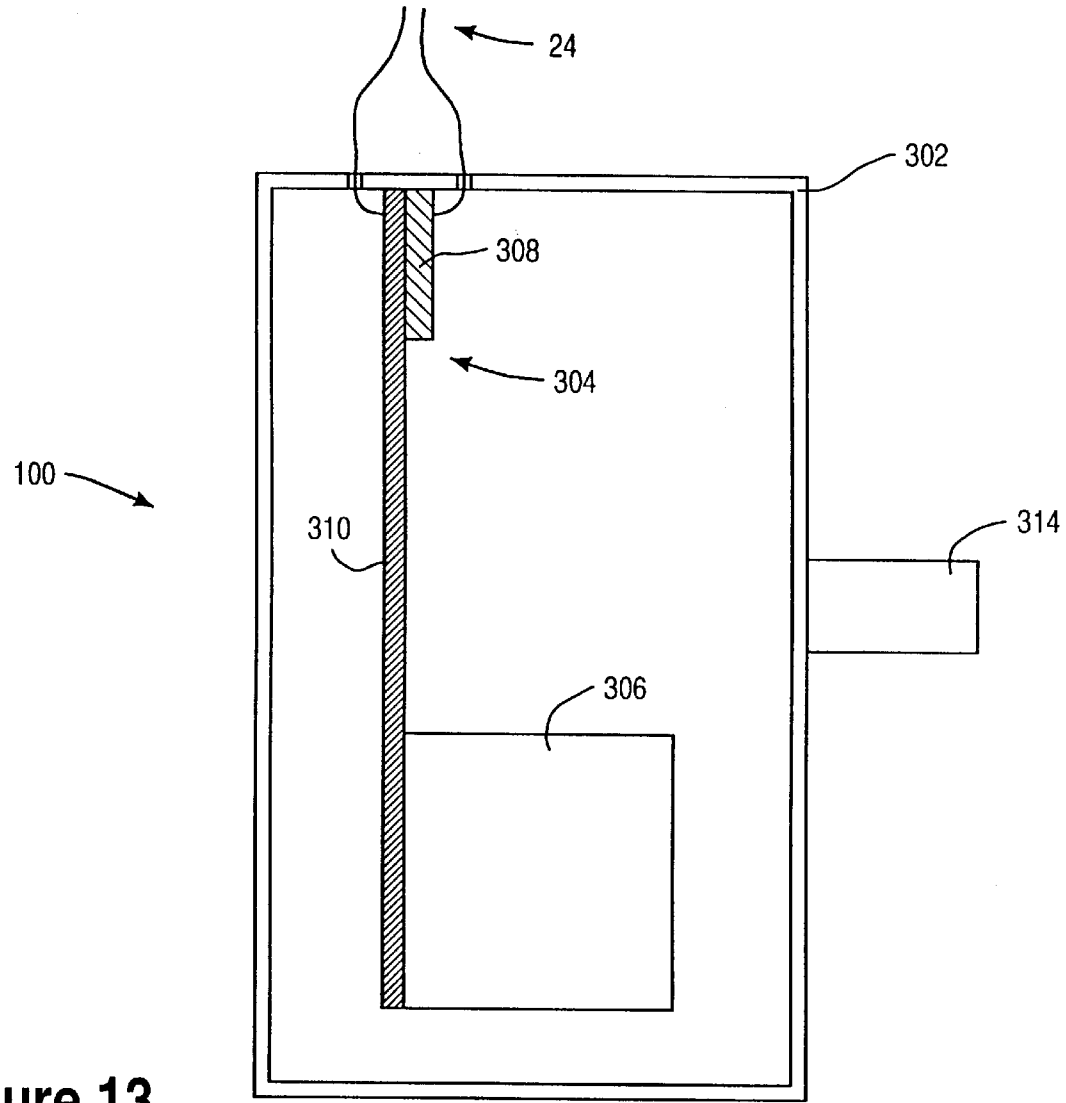
FIG. 13 is a cross-sectional view of an embodiment of a floating mass transducer having a piezoelectric element.

The structure of a piezoelectric floating mass transducer according to the present invention is shown in FIG. 13. In this embodiment, the floating mass is caused to vibrate by a piezoelectric bimorph. A transducer 100 is generally comprised of a housing 302 having a bimorph assembly 304 and a driving weight 306 disposed inside it. The housing is generally a sealed rectangular capsule. One end of the bimorph assembly 304 is secured to the inside of the housing and is composed of a short piezoelectric strip 308 and a longer piezoelectric strip 310. The two strips are oriented so that one strip contracts while the other expands when a voltage is applied across the strips through leads 24.

Driving weight 306 is secured to one end of piezoelectric strip 310 (the "cantilever"). When alternating current is conducted to the bimorph assembly, the housing and driving weight oscillate relative to each other causing the housing to vibrate. Preferably, the relative vibration of the housing is substantially greater than the vibration of the driving weight. A clip may be secured to the housing which allows the transducer to be attached to the incus MM as is shown in FIG. 5*a*.

For the device to operate properly, it must vibrate a vibratory structure with sufficient force such that the vibrations are perceived as sound waves. The force of vibrations are best maximized by optimizing two parameters: the mass of the driving weight relative to the mass of the housing, and the efficiency of the piezoelectric bimorph assembly.

The ratio of the mass of the driving weight to the mass of the housing is most easily optimized by constructing the housing of a thinly machined, lightweight material such as titanium and by configuring the driving weight to fill a large portion of the space inside the housing, although there must be adequate spacing between the driving weight and the housing so that the housing does not contact the driving weight when it vibrates.

Figure 14:
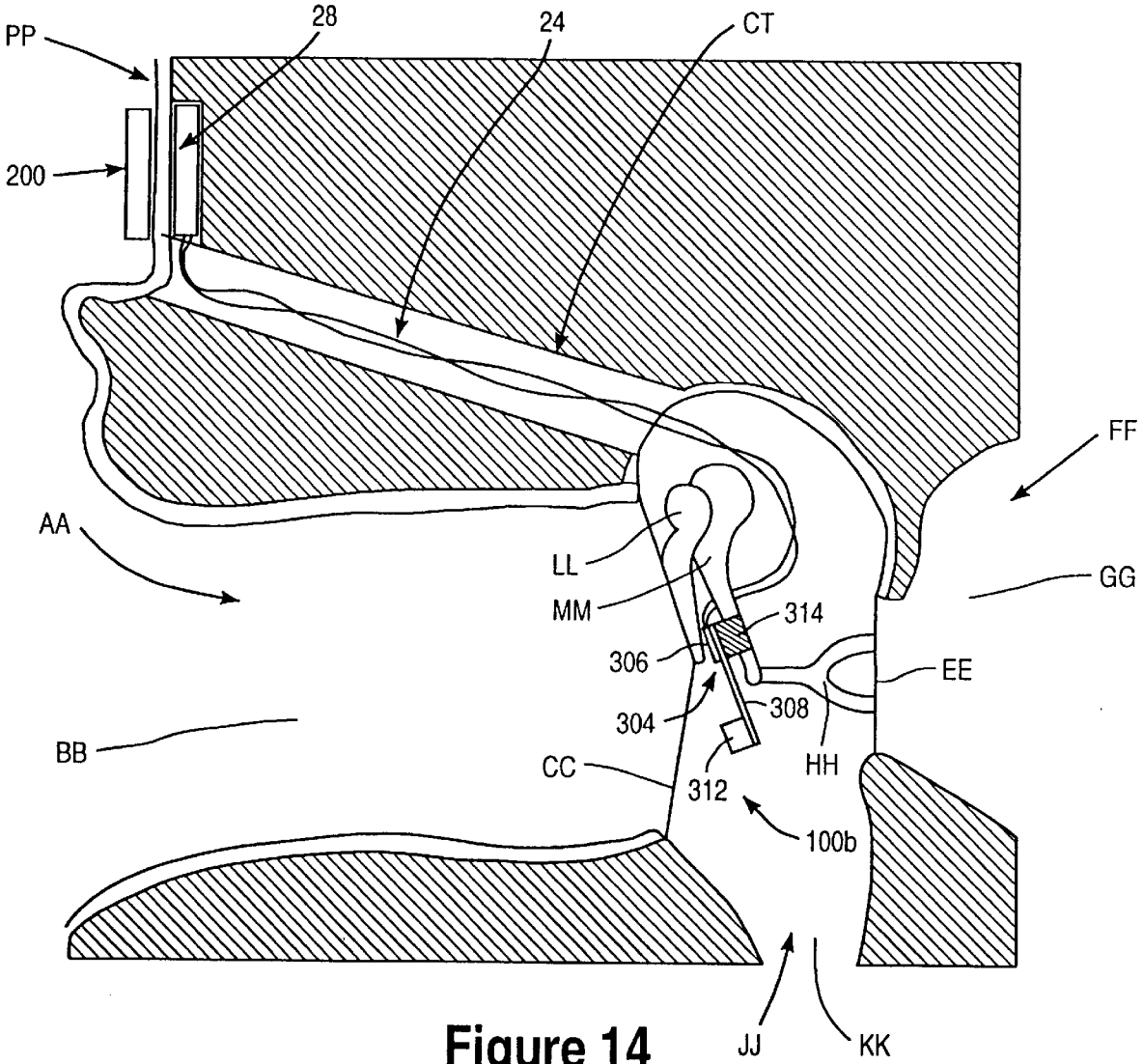
FIG. 14 is a schematic representation of a portion of the auditory system showing a floating mass transducer having a piezoelectric element positioned for receiving alternating current from a subcutaneous coil inductively coupled to an external sound transducer positioned outside a patient's head.

In another embodiment, the piezoelectric bimorph assembly and driving mass are not within a housing. Although the floating mass is caused to vibrate by a piezoelectric bimorph, the bimorph assembly is secured directly to an ossicle (e.g., the incus MM) with a clip as shown in FIG. 14. A transducer 100*b* has a bimorph assembly 304 composed of a short piezoelectric strip 306 and a longer piezoelectric strip 308. As before, the two strips are oriented so that one strip contracts while the other expands when a voltage is applied across the strips through leads 24. One end of the bimorph assembly is secured to a clip 314 which is shown fastened to the incus. A driving weight 312 is secured to the end of piezoelectric strip 308 opposite the clip in a position that does not contact the ossicles or surrounding tissue. Preferably, the mass of the driving weight is chosen so that all or a substantial portion of the vibration created by the transducer is transmitted to the incus.

Although the bimorph piezoelectric strips have been shown with one long portion and one short portion. The whole cantilever may be composed of bimorph piezoelectric strips of equal lengths.

B. Thin Membrane

Figure 15B:
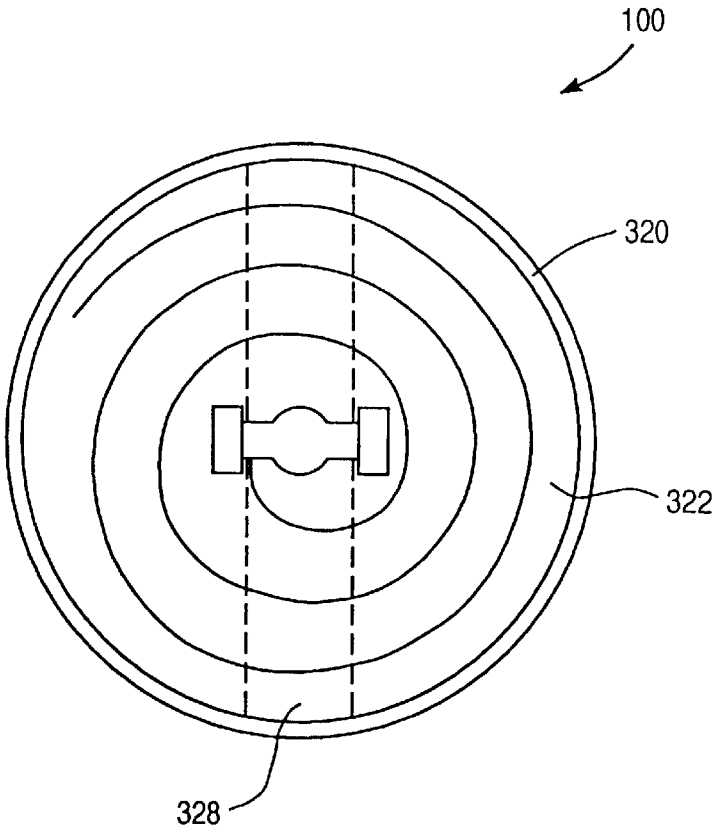
FIG. 15*b* is a side view of the floating mass transducer of FIG. 15*a*.
Figure 15A:
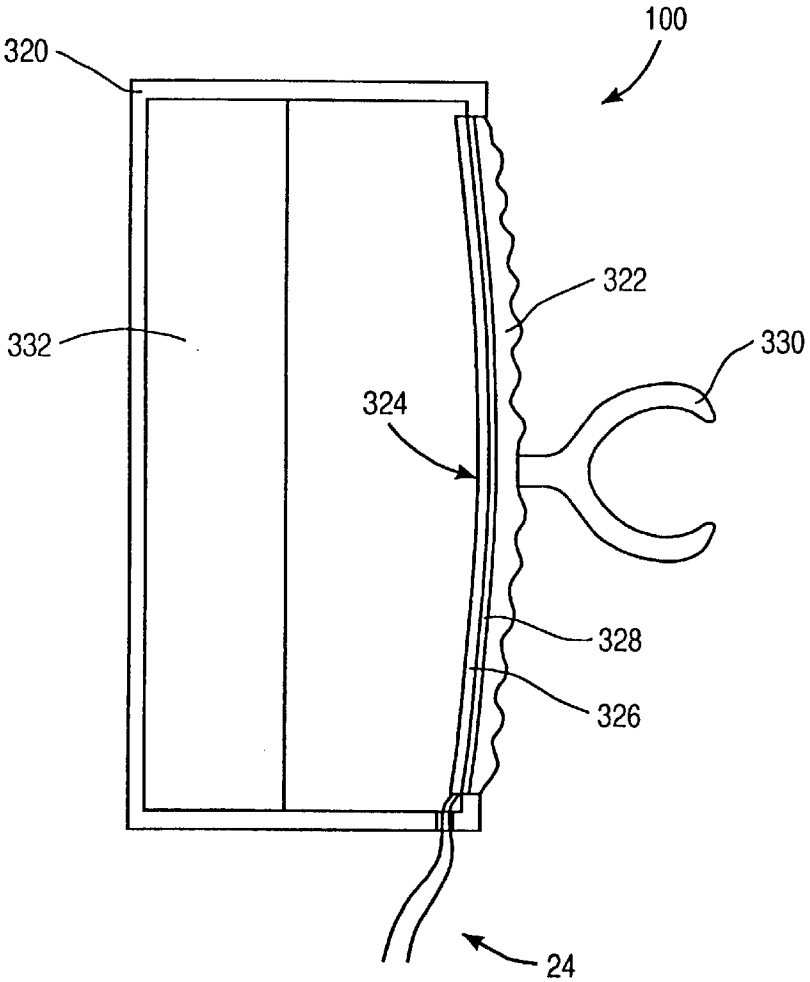
FIG. 15*a* is a cross-sectional view of an embodiment of a floating mass transducer having a thin membrane incorporating a piezoelectric strip.

The structure of another embodiment of a floating mass transducer according to the present invention is shown in FIGS. 15*a* and 15*b*. In this embodiment, the floating mass is cause to vibrate by a piezoelectric bimorph in association with a thin membrane. The transducer 100 is comprised of a housing 320 which is generally a cylindrical capsule with one end open which is sealed by a flexible diaphragm 322. A bimorph assembly 324 is disposed within the housing and secured to the flexible diaphragm. The bimorph assembly is includes two piezoelectric strips 326 and 328. The two strips are oriented so that one strip contracts while the other expands when a voltage is applied across the strips through leads 24. The diaphragm is shown having a clip 330 attached to center of the diaphragm which allows the transducer to be attached to an ossicle.

When alternating current is conducted to the bimorph assembly, the diaphragm vibrates. Preferably, the relative vibration of the bimorph assembly and diaphragm is substantially greater than the vibration of the housing. For the device to operate properly, it must vibrate a vibratory structure with sufficient force such that the vibrations are perceived as sound waves. The force of vibrations are best maximized by optimizing two parameters: the mass of the housing relative to the combined mass of the bimorph assembly and diaphragm.

The ratio of the mass of the housing to the combined mass of the bimorph assembly and diaphragm is most easily optimized by securing a weight 332 within the housing. The housing may be composed of a biocompatible material like titanium.

C. Piezoelectric Stack

Figure 16:
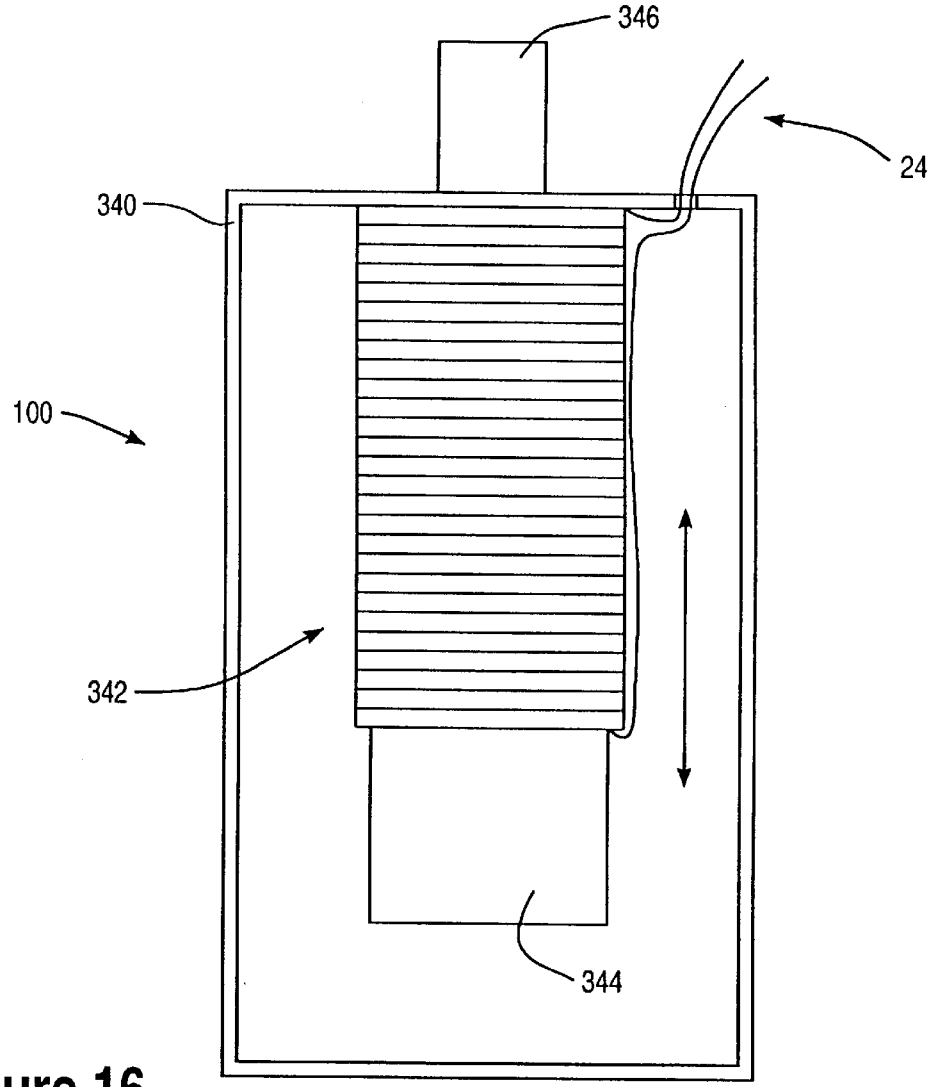
FIG. 16 is a cross-sectional view of an embodiment of a floating mass transducer having a piezoelectric stack.

The structure of a piezoelectric floating mass transducer according to the present invention is shown in FIG. 16. In this embodiment, the floating mass is caused to vibrate by a stack of piezoelectric strips. A transducer 100 is generally comprised of a housing 340 having a piezoelectric stack 342 and a driving weight 344 disposed inside it. The housing is generally a sealed rectangular capsule.

The piezoelectric stack is comprised of multiple piezoelectric sheets. One end of piezoelectric stack 340 is secured to the inside of the housing. Driving weight 344 is secured to the other end of the piezoelectric stack. When a voltage is applied across the piezoelectric strips through leads 24, the individual piezoelectric strips expand or contract depending on the polarity of the voltage. As the piezoelectric strips expand or contract, the piezoelectric stack vibrates along the double headed arrow in FIG. 16.

When alternating current is conducted to the piezoelectric stack, the driving weight vibrates causing the housing to vibrate. Preferably, the relative vibration of the housing is substantially greater than the vibration of the driving weight. A clip 346 may be secured to the housing to allow the transducer to be attached to an ossicle.

For the device to operate properly, it must vibrate a vibratory structure with sufficient force such that the vibrations are perceived as sound waves. The force of vibrations are best maximized by optimizing two parameters: the mass of the driving weight relative to the mass of the housing, and the efficiency of the piezoelectric strips.

The ratio of the mass of the driving weight to the mass of the housing is most easily optimized by constructing the housing of a thinly machined, lightweight material such as titanium and by configuring the driving weight to fill a large portion of the space inside the housing, although there must be adequate spacing between the driving weight and the housing so that the housing does not contact the driving weight when it vibrates.

D. Dual Piezoelectric Strips

Figure 17:
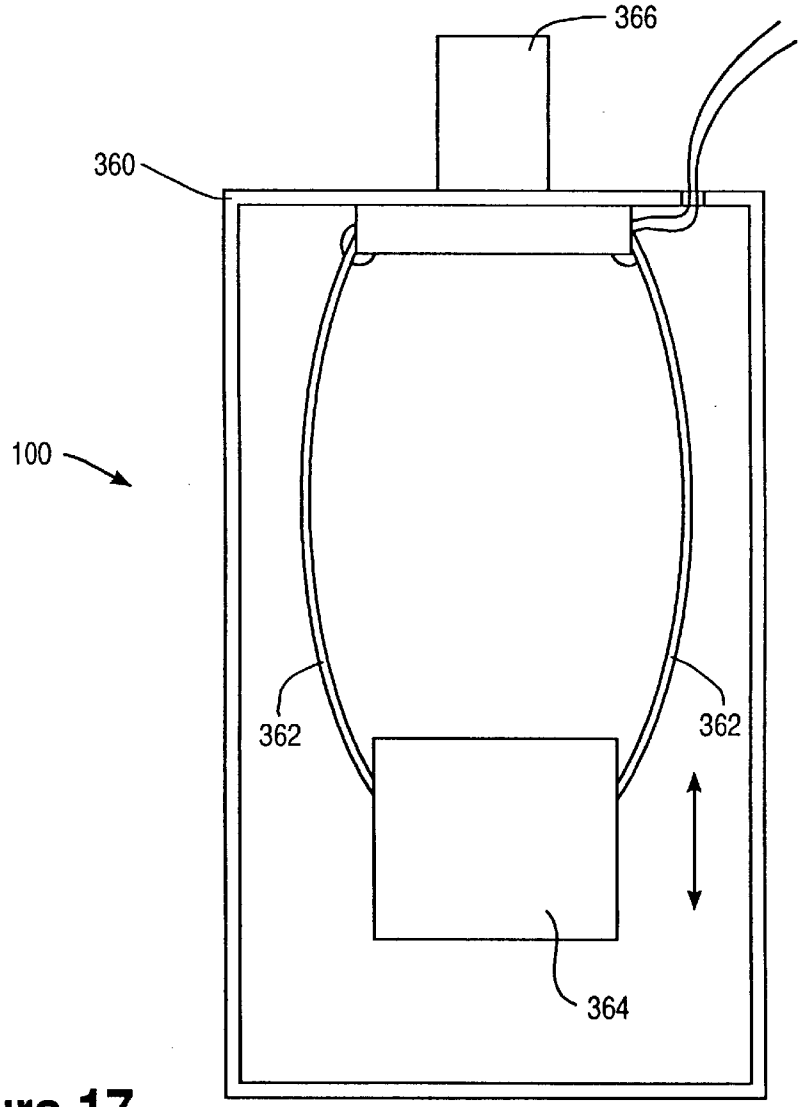
FIG. 17 is a cross-sectional view of an embodiment of a floating mass transducer having dual piezoelectric strips.

The structure of a piezoelectric floating mass transducer according to the present invention is shown in FIG. 17. In this embodiment, the floating mass is caused to vibrate by dual piezoelectric strips. A transducer 100 is generally comprised of a housing 360 having piezoelectric strips 362 and a driving weight 364 disposed inside it. The housing is generally a sealed rectangular capsule.

One end of each of the piezoelectric strips is secured to the inside of the housing. Driving weight 364 is secured to the other end of each of the piezoelectric strips. When a voltage is applied across the piezoelectric strips through leads 24, the piezoelectric strips expand or contract depending on the polarity of the voltage. As the piezoelectric strips expand or contract, the driving weight vibrates along the double headed arrow in FIG. 17.

When alternating current is conducted to the piezoelectric strips, the driving weight vibrates causing the housing to vibrate. Preferably, the relative vibration of the housing is substantially greater than the vibration of the driving weight. A clip 366 may be secured to the housing to allow the transducer to be attached to an ossicle.

For the device to operate properly, it must vibrate a vibratory structure with sufficient force such that the vibrations are perceived as sound waves. The force of vibrations are best maximized by optimizing two parameters: the mass of the driving weight relative to the mass of the housing, and the efficiency of the piezoelectric strips.

The ratio of the mass of the driving weight to the mass of the housing is most easily optimized by constructing the housing of a thinly machined, lightweight material such as titanium and by configuring the driving weight to fill a large portion of the space inside the housing, although there must be adequate spacing between the driving weight and the housing so that the housing does not contact the driving weight when it vibrates.

This embodiment has been described as having two piezoelectric strips. However, more than two piezoelectric strips may also be utilized.

IV. EXTERNAL FLOATING MASS TRANSDUCER CONFIGURATION

A. Coupled

Figure 18:
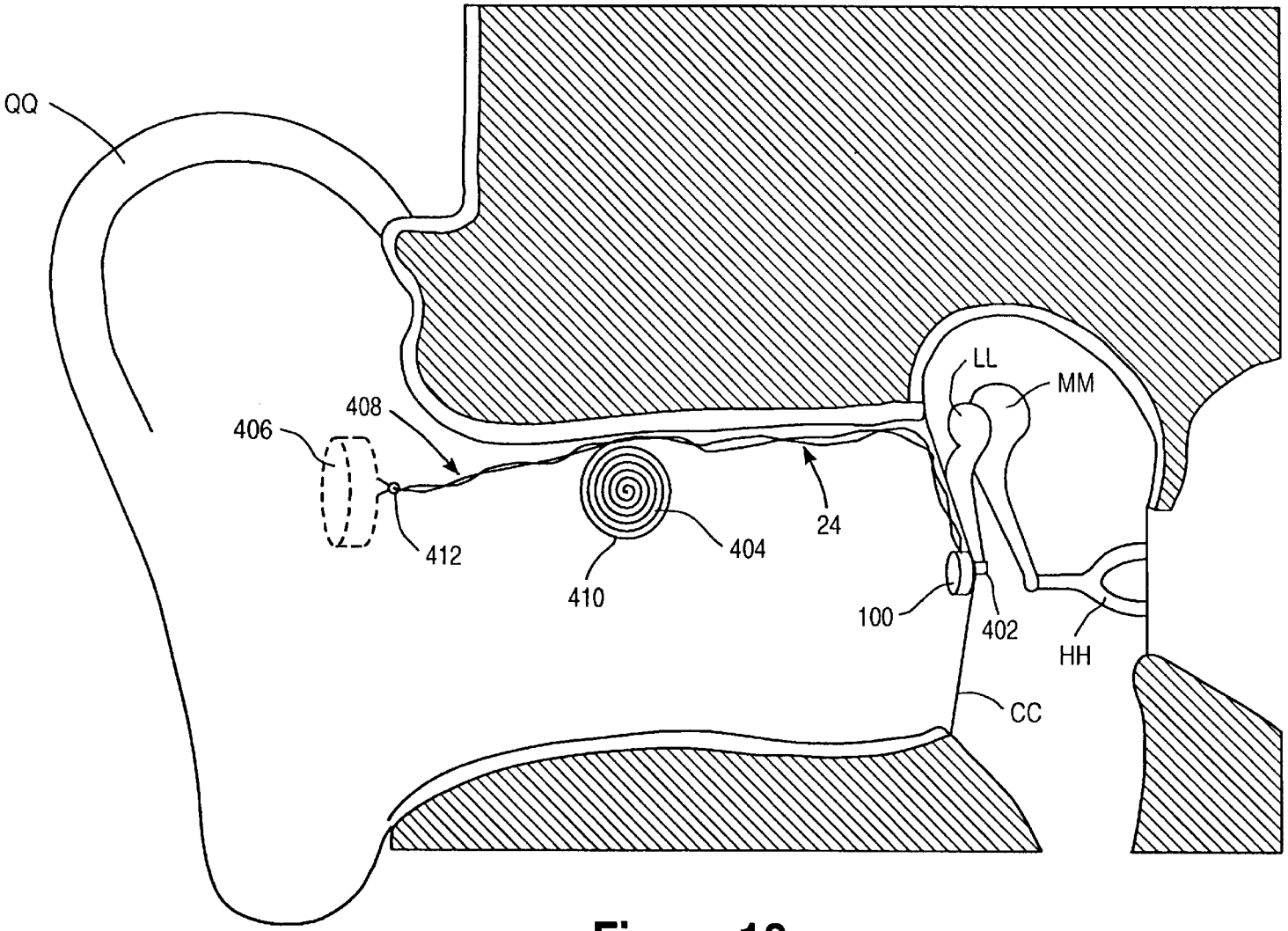
FIG. 18 is a schematic representation of a portion of the auditory system showing a floating mass transducer attached to the tympanic membrane for receiving alternating current from a pickup coil in the ear canal.

A floating mass transducer according to the present invention may also be attached to the tympanic membrane in the external ear. FIG. 18 illustrates a floating mass transducer attached to the tympanic membrane. A transducer 100 is shown attached to the malleus LL through the tympanic membrane CC with a clip 402. The transducer can also be attached to the tympanic membrane by other methods including screws, sutures, and the like. The transducer receives alternating current via leads 24 which run along the ear canal to a pickup coil 404.

An external sound transducer 406 is positioned behind the concha QQ. The external sound transducer is substantially identical in design to a conventional hearing aid transducer and is comprised of a microphone, sound processing unit, amplifier, and battery, none of which are depicted in detail. Sound waves are converted to an electrical signal by the microphone and sound processor of the external sound transducer. The amplifier boosts the signal and delivers it via leads 408 to a driver coil 410. Leads 408 pass from the back of the concha to the front of the concha through a hole 412. The leads could also be routed over the concha or any one of a number of other routes. The driver coil is adjacent to the pickup coil so there are actually two coils within the ear canal.

The driver coil delivers the signal to pickup coil 404 by magnetic induction. The pickup coil produces an alternating current signal on leads 24 which the floating mass transducer translates into a vibration in the middle ear as described earlier. Although this implementation has been described as having driver and pickup coils, it may also be implemented with a direct lead connection between the external sound transducer and the floating mass transducer.

An obvious advantage of this implementation is that surgery into the middle ear to implant the transducer is not required. Thus, the patient may have the transducer attached to an ossicle without the invasive surgery necessary to place the transducer in the middle ear.

B. Non-coupled

A floating mass transducer according to the present invention may be removably attached (i.e., non-coupled) to the tympanic membrane in the external ear. The following paragraphs describe different implementations where the floating mass transducer is removably attached to the tympanic membrane.

Figure 19A:
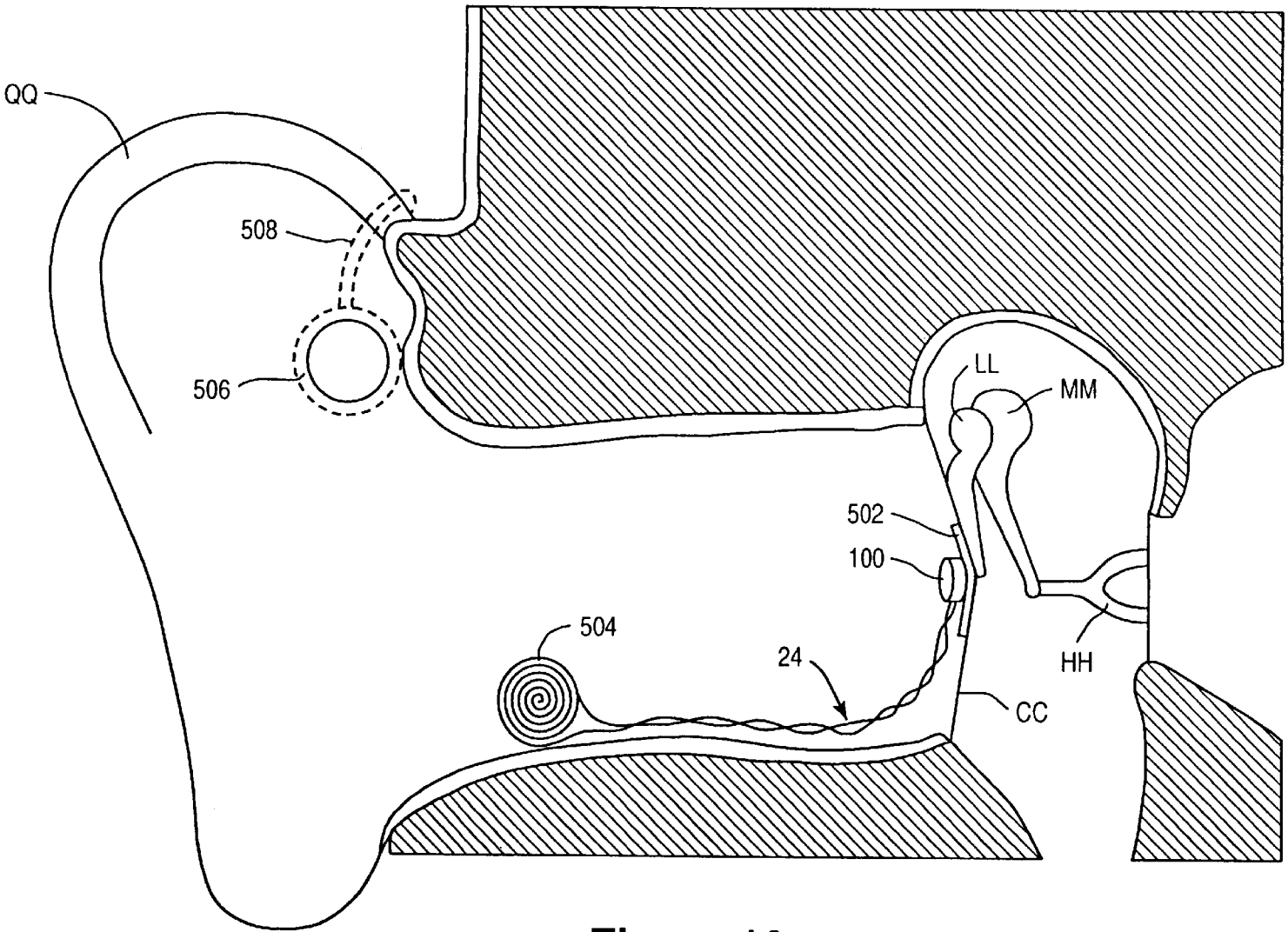
FIG. 19*a* is a schematic representation of a portion of the auditory system showing a floating mass transducer removably attached to the tympanic membrane for receiving alternating current from a pickup coil in the ear canal.

FIG. 19*a* illustrates an implementation where the floating mass transducer of the present invention is removably placed in contact with the tympanic membrane. A transducer 100 is shown attached to the tympanic membrane CC with a flexible membrane 502. The flexible membrane may be composed of silicone and holds the transducer in contact with the tympanic membrane through suction action, an adhesive, and the like. The transducer receives alternating current via leads 24 which run along the ear canal to a pickup coil 504. The transducer, leads and pickup coil may made so that they are disposable.

An external sound transducer 506 is positioned behind the concha QQ. The external sound transducer is substantially identical in design to a conventional hearing aid transducer and is comprised of a microphone, sound processing unit, amplifier, battery, and driver coil, none of which are depicted in detail. Sound waves are converted to an electrical signal by the microphone and sound processor of the external sound transducer. The microphone may include a tube 508 that allows it to better receive sound from in front of the concha. The amplifier boosts the signal and delivers it to the driver coil within the external sound transducer.

The driver coil delivers the signal to pickup coil 504 by magnetic induction. The pickup coil produces an alternating current signal on leads 24 which the floating mass transducer translates into a vibration in the middle ear as described earlier. Although this implementation has been described as having driver and pickup coils, it may also be implemented with a direct lead connection between the external sound transducer and the floating mass transducer.

Figure 19B:
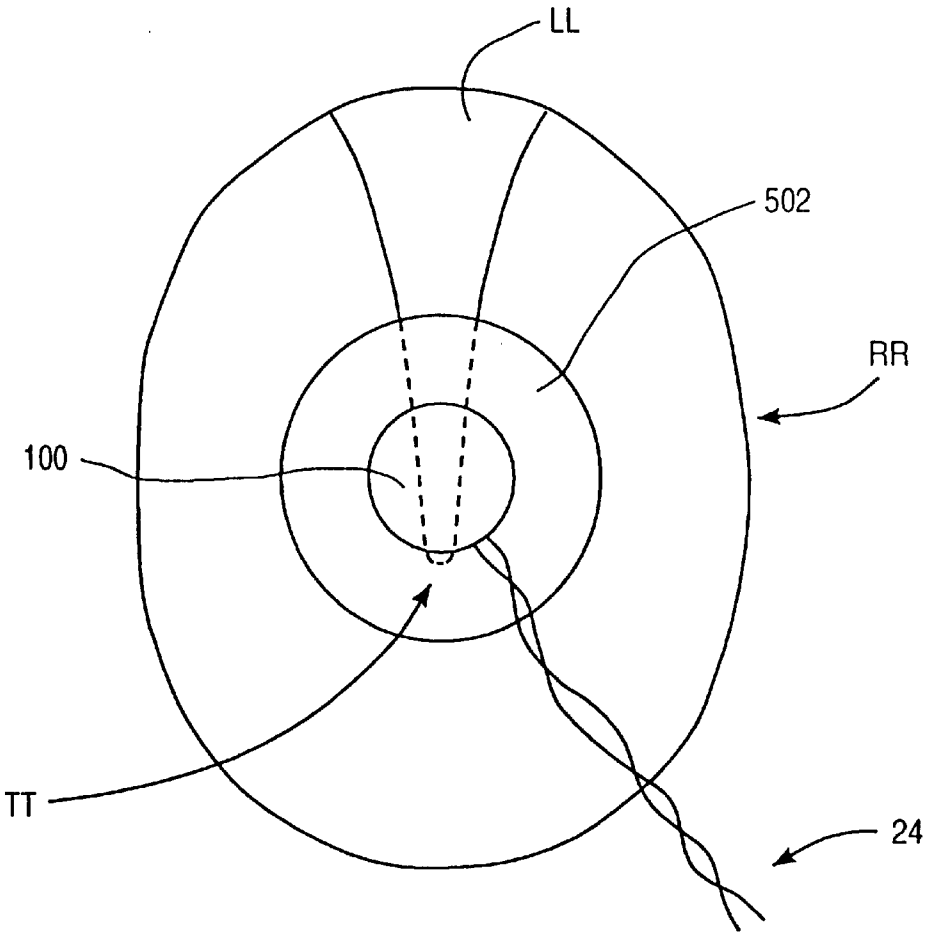
FIG. 19*b* illustrates the position of a floating mass transducer on the tympanic membrane.

FIG. 19*b* illustrates the position of the floating mass transducer on the tympanic membrane. Transducer 100 and flexible membrane 502 are positioned within the annular ring RR. Preferably, the transducer is placed near the umbo region TT.

Figure 20B:
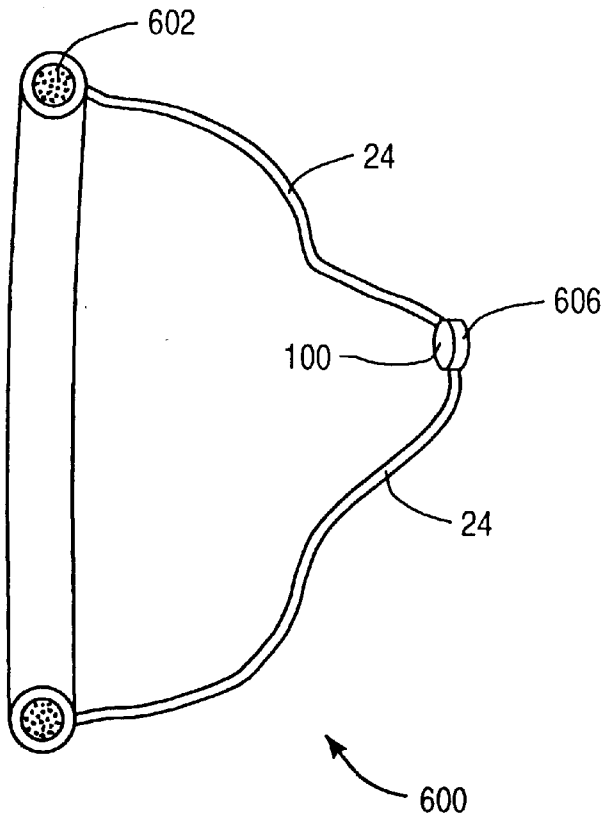
FIG. 20*b* is a cross-sectional view of the flexible insert.
Figure 20A:
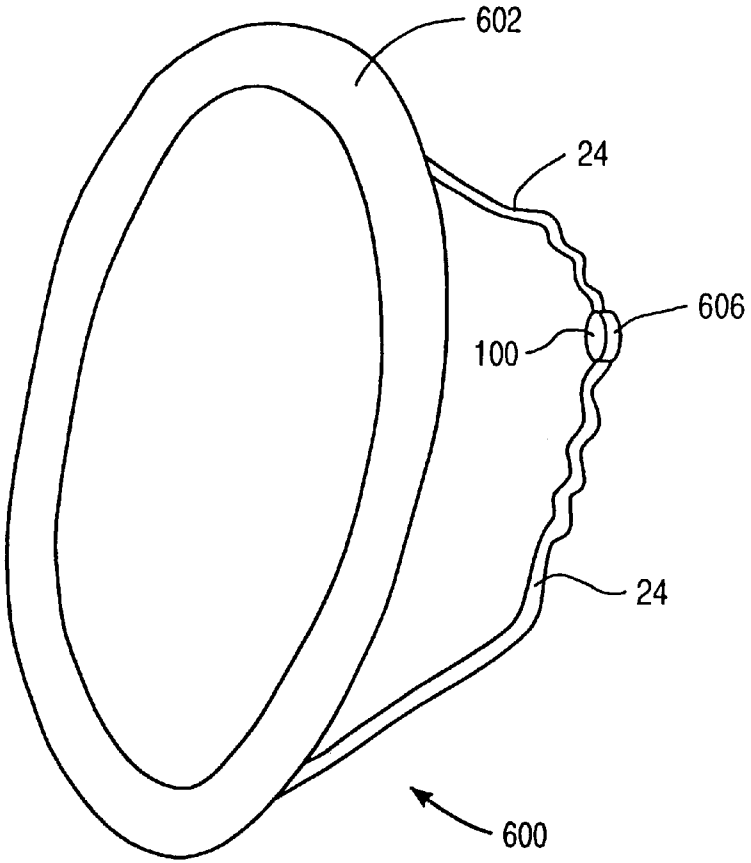
FIG. 20*a* is a perspective view of a flexible insert incorporating a floating mass transducer.

FIG. 20*a* illustrates a flexible insert that is used in another implementation where the floating mass transducer of the present invention is removably placed in contact with the tympanic membrane. A flexible insert 600 is primarily composed of a pickup coil 602, leads 24, and a floating mass transducer 610. Pickup coil 602 is preferably coated with a soft flexible material like poly vinyl or silicone. The pickup coil is connected to leads 24 which are flexible and may have a characteristic wavy pattern to provide strain relief to provide durability to the leads by reducing the damaging effects of the vibrations. The leads provide alternating current from the pickup coil to transducer 100 which is placed in contact with the umbo region of the tympanic membrane. Preferably, the transducer has a soft coating 606 (e.g., silicone) on the side that will be in contact with the tympanic membrane. FIG. 20*b* illustrates a side view of flexible insert 600. The flexible insert may also be designed with more than two flexible leads that support the transducer.

Figure 20C:
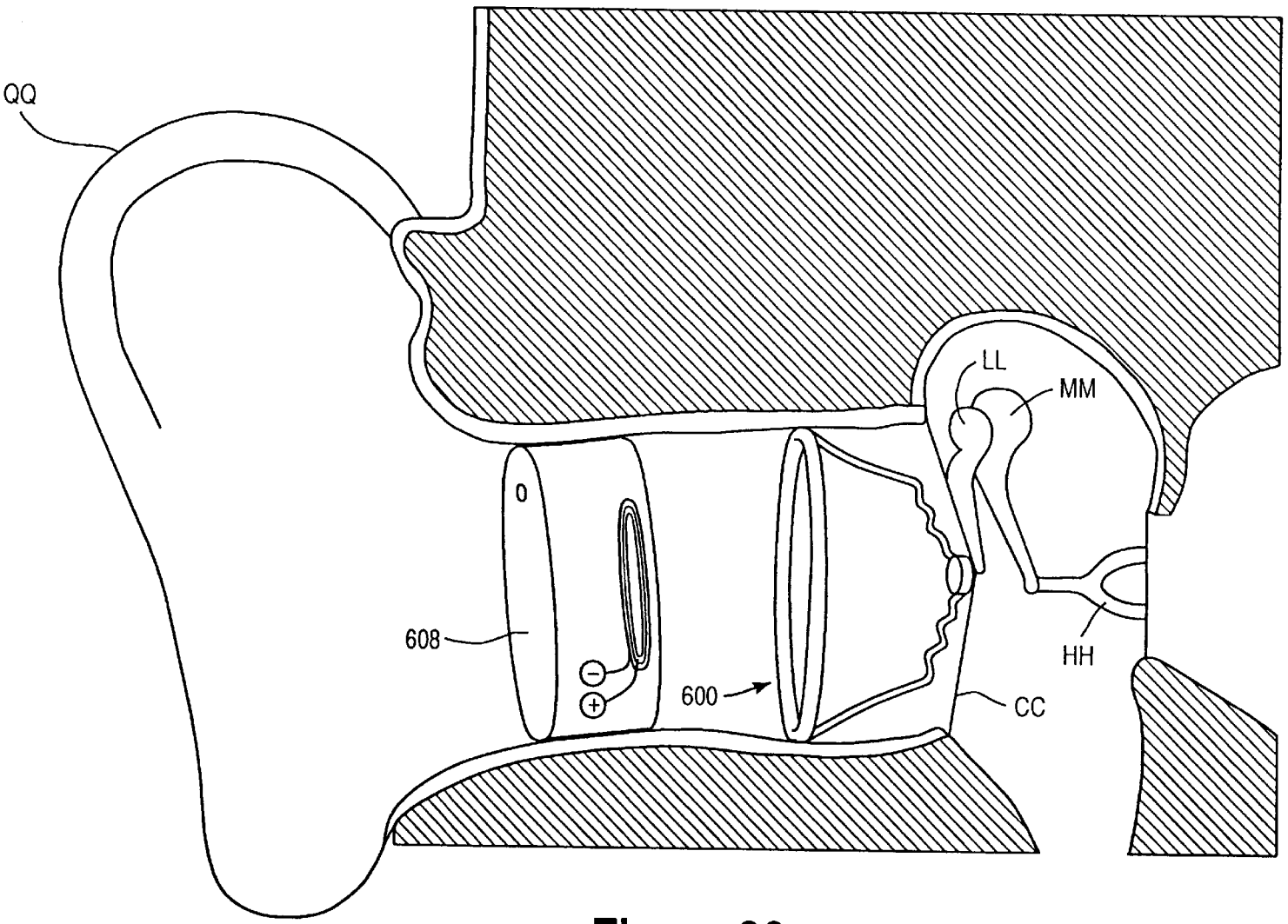
FIG. 20*c* is a schematic representation of a portion of the auditory system showing the flexible insert in the ear canal.

FIG. 20*c* illustrates the position of the flexible insert in the ear canal. Flexible insert 600 is placed deep within the ear canal so that the floating mass transducer is in contact with the tympanic membrane. The pickup coil may be driven by magnetic induction by an external sound transducer 608 comprised of a microphone, sound processing unit, amplifier, battery, and driver coil, none of which are depicted in detail. Although the external sound transducer is shown in the ear canal, it may also be placed at other locations, including behind the concha. Also, the external sound transducer can be made in the form of a necklace. The driver coil would encircle the patient's neck and produce a magnetic field that drives the pickup coil by magnetic induction.

Figure 21A:
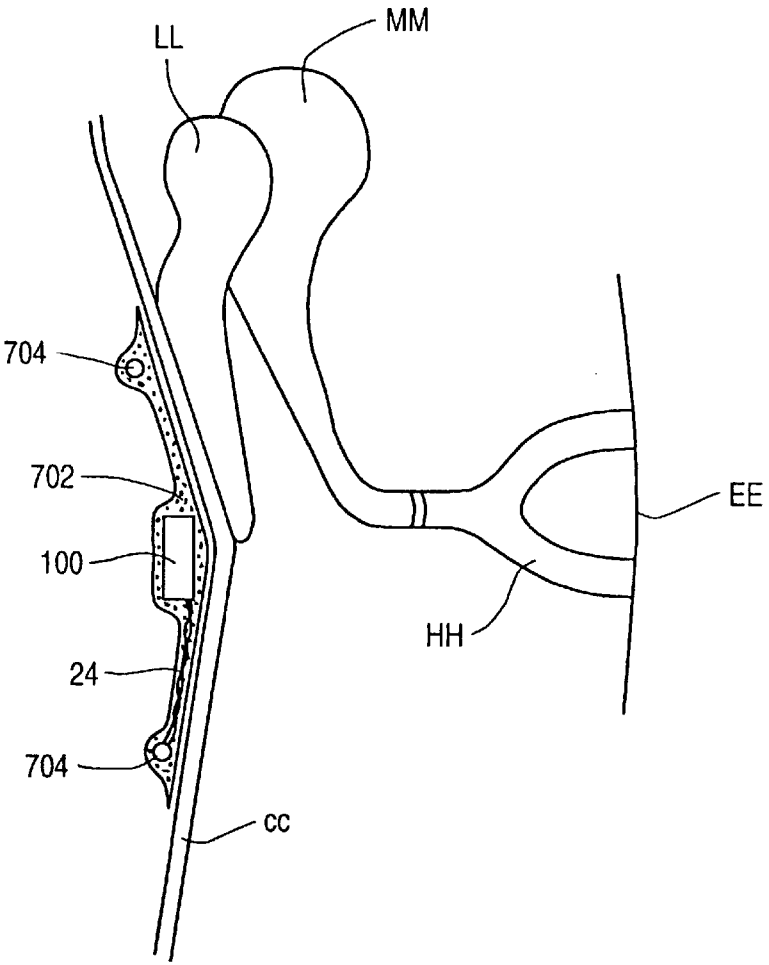
FIG. 21*a* is a schematic representation of a portion of the auditory system showing another implementation where a floating mass transducer is placed in contact with the tympanic membrane.

FIG. 21*a* illustrates another implementation where the floating mass transducer of the present invention is removably placed in contact with the tympanic membrane. A transducer 100 is shown attached to the tympanic membrane CC with a flexible membrane 702. The flexible membrane may be composed of silicone and holds the transducer in contact with the tympanic membrane through suction action or an adhesive. The transducer receives alternating current via leads 24 which run through the flexible membrane to a pickup coil 704. The pickup coil may be disposed within the flexible membrane and driven by a driver coil (not shown) as described earlier.

Figure 21B:
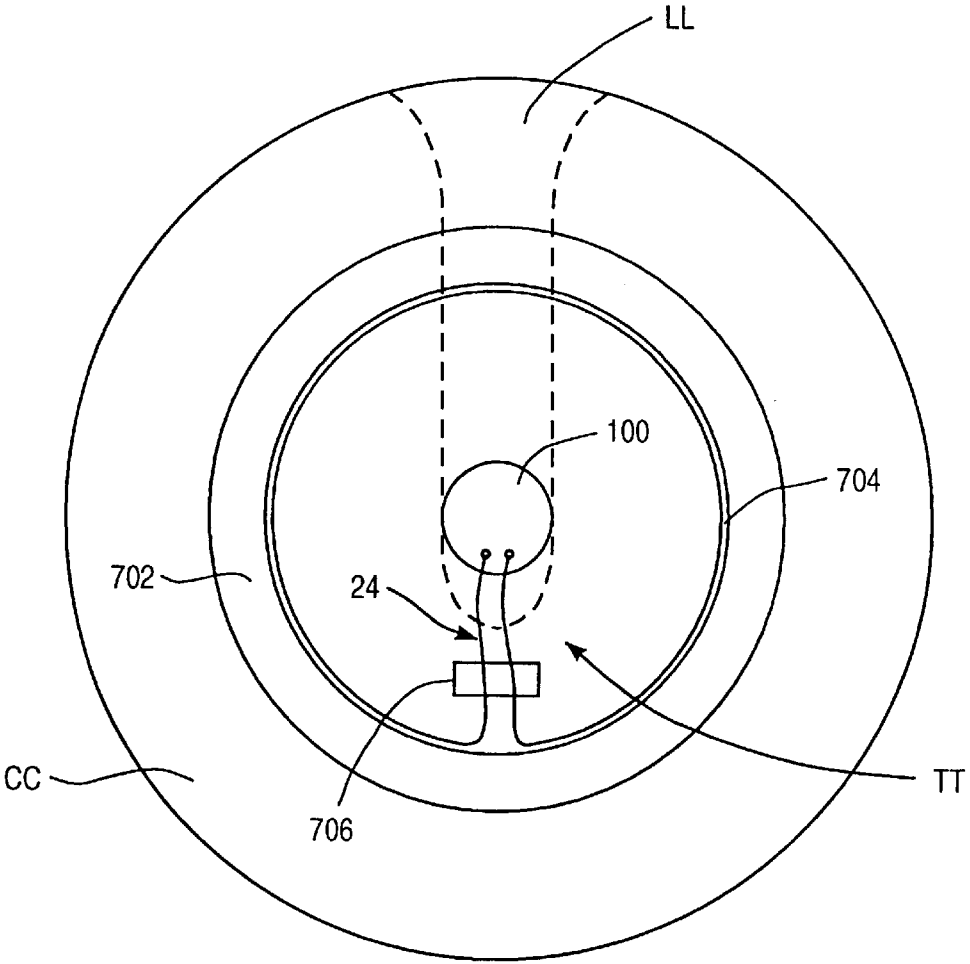
FIG. 21*b* illustrates the position of the flexible a floating mass transducer on the tympanic membrane.

FIG. 21*b* illustrates the position of the floating mass transducer of FIG. 21*a* on the tympanic membrane. Transducer 100 and flexible membrane 702 are positioned on the tympanic membrane CC. Preferably, the transducer is placed near the umbo region TT. A demodulator circuit 706 may be placed within the flexible membrane between the pickup coil and transducer if a modulated signal from a driver coil is used.

The advantages of these implementations is that surgery into the middle ear to implant the transducer is not required. Additionally, these implementations provide a way for a patient to try out a floating mass transducer without undergoing any surgery.

C. Concha Plug

Figure 22:
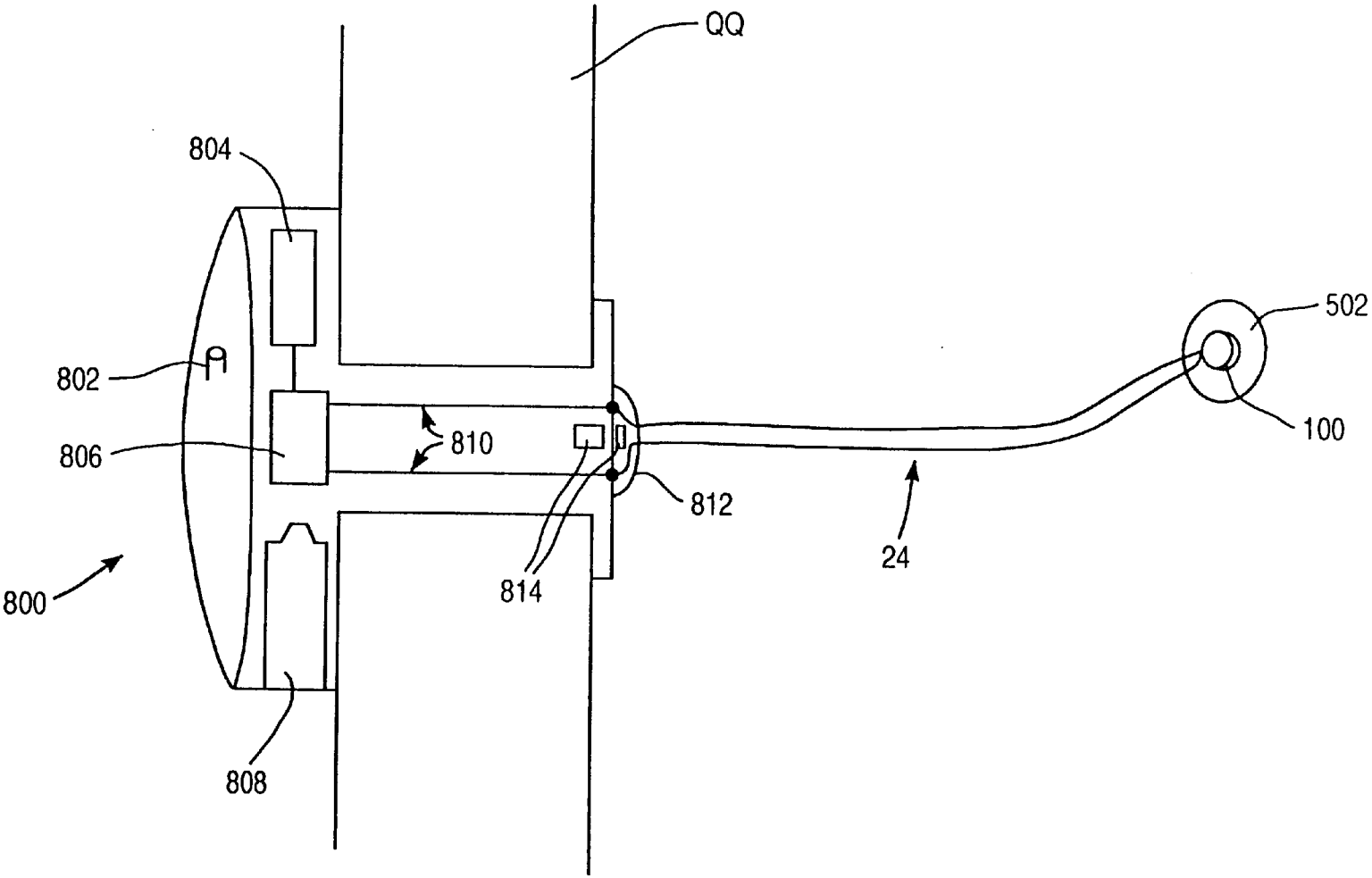
FIG. 22 is a schematic representation of a portion of the auditory system showing a cross-sectional view of an external sound transducer concha plug.

The present invention provides an external sound transducer that is attached to the concha as a concha plug. FIG. 22 illustrates the placement of the external sound transducer concha plug. A small hole or incision is made in the concha and an external sound-transducer 800 is inserted in the hole in the concha. The external sound transducer is comprised of a microphone 802, sound processor 804, amplifier 806, and a battery within the battery door 808. The microphone may also include a microphone tube as shown in FIG. 19*a* for better reception.

In operation, the external sound transducer is substantially identical in design to a conventional hearing aid transducer. Sound waves are converted to an electrical signal by the microphone and sound processor of the external sound transducer. The amplifier boosts the signal and delivers it via leads 810 to the front of the concha QQ. At the front of the concha, leads 810 are electrically connected to leads 24 that transmit the alternating signal current to a floating mass transducer 100. Transducer 100 may be attached to the tympanic membrane in any of the ways described and is shown with a flexible membrane 502.

As it may be desirable to have the leads of the external sound transducer and the floating mass transducer separable, leads 24 may end in a cap 812. The cap is designed with lead connections and is removable from the external sound transducer. The cap shown is held in place by magnets 814.

V. INTERNAL FLOATING MASS TRANSDUCER CONFIGURATION

A. Middle Ear Attachment Without Disarticulation

A floating mass transducer according to the present invention may be implanted in the middle ear without disarticulation of the ossicles. FIG. 5*a* shows how a floating mass transducer may be clipped onto the incus. However, a floating mass transducer may also be clipped or otherwise secured (e.g., surgical screws) to any of the ossicles.

Figure 23:
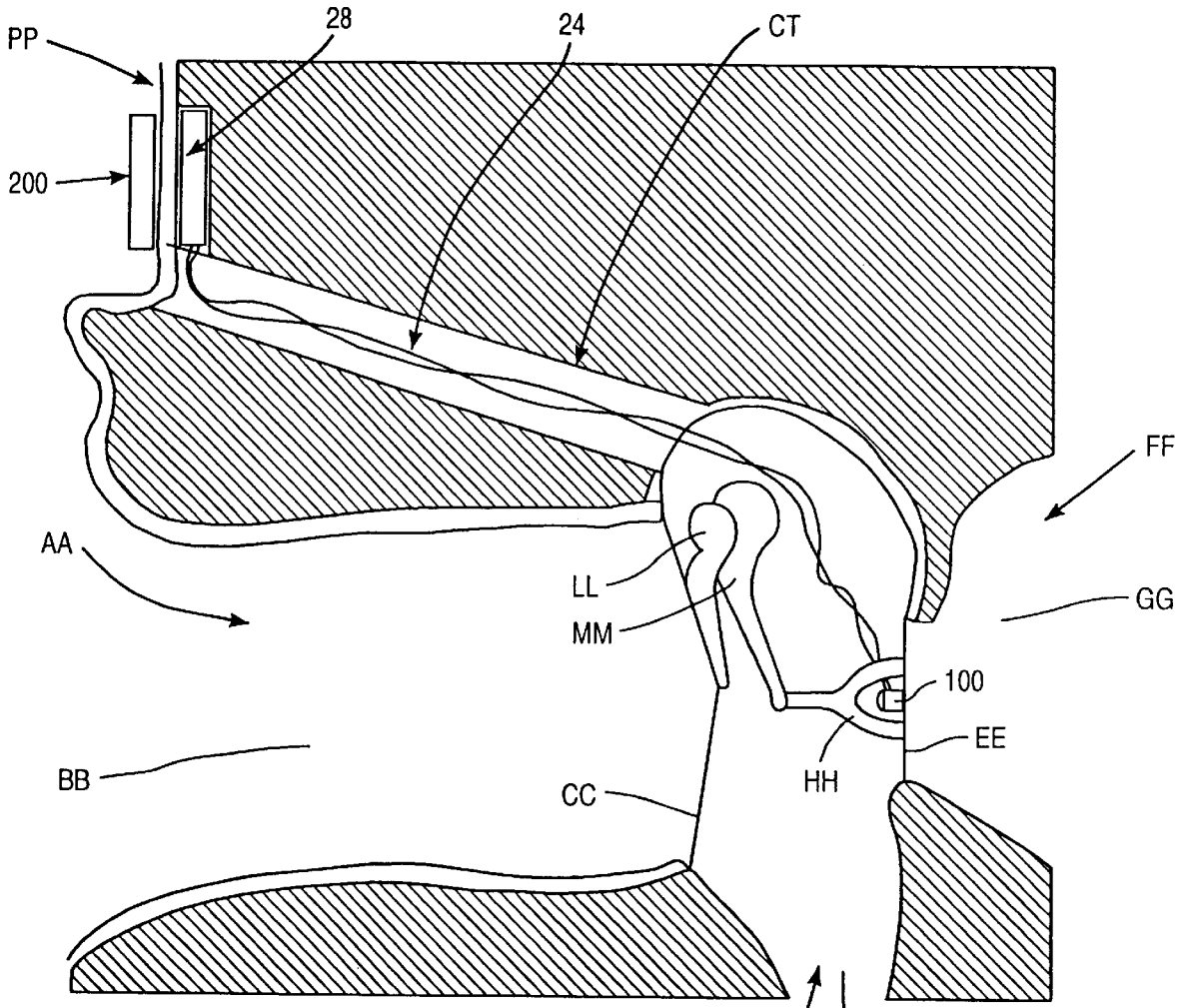
FIG. 23 is a schematic representation of a portion of the auditory system showing a floating mass transducer positioned on the oval window for receiving alternating current from a subcutaneous coil inductively coupled to an external sound transducer positioned outside a patient's head.

FIG. 23 illustrates how a floating mass transducer may be secured to the oval window in the middle ear. A floating mass transducer 100 may be attached to the oval window with an adhesive, glue, suture, and the like. Alternatively, the transducer may be held in place by being connected to the stapes HH. Attaching the transducer to the oval window provides direct vibration of the cochlear fluid of the inner ear. Additionally, a floating mass transducer-may be attached to the middle ear side of the tympanic membrane.

Attaching a floating mass transducer in the middle ear without disarticulation provides the benefit that the patient's natural hearing is preserved.

B. Total and Partial Ossicular Replacement Prostheses

A floating mass transducer may be utilized in a total or partial ossicular replacement prosthesis as shown in FIGS. 8 and 9. The ossicular replacement prosthesis may incorporate any of the floating mass transducers described herein. Therefore, the discussion of ossicular replacement prostheses in reference to one embodiment of a floating mass transducer does not imply that only that embodiment may be used. One of skill in the art would readily be able to fashion ossicular replacement prostheses using any of the embodiments of the floating mass transducer of the present invention.

C. Fully Internal

A hearing aid having a floating mass transducer may also be implanted to be fully internal. In this implementation, a floating mass transducer is secured within the middle ear in any of the ways described above. One of the difficulties encountered when trying to produce a fully implantable hearing aid is the microphone. However, a floating mass transducer can also function as an internal microphone.

Figure 24:
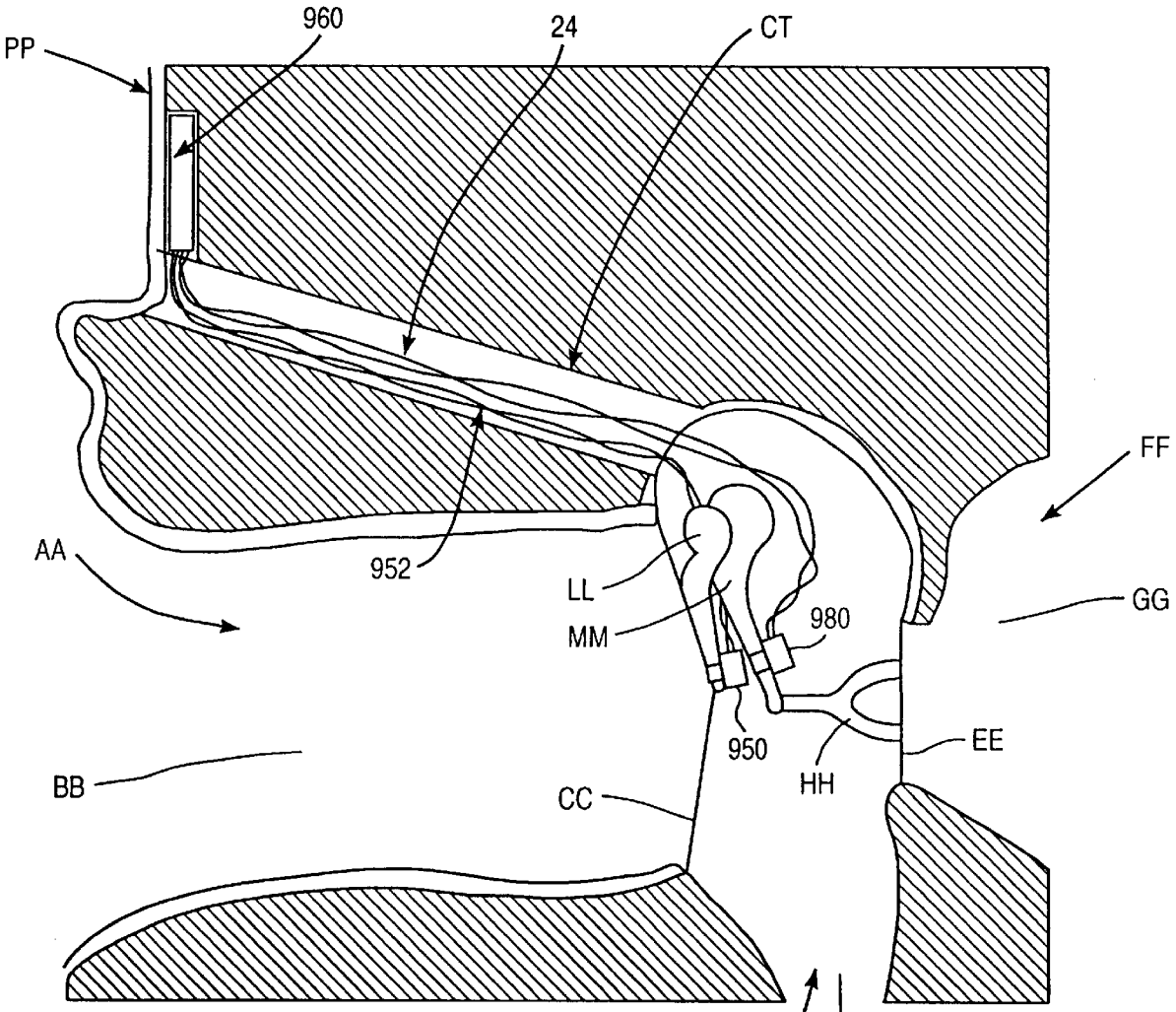
FIG. 24 is a schematic representation of a portion of the auditory system showing a fully internal hearing aid incorporating floating mass transducers.

FIG. 24 illustrates a fully internal hearing aid utilizing a floating mass transducer. A floating mass transducer 950 is attached by a clip to the malleus LL. Transducer 950 picks up vibration from the malleus and produces an alternating current signal on leads 952. Therefore, transducer 950 is the equivalent of an internal microphone.

A sound processor 960 comprises a battery, amplifier, and signal processor, none shown in detail. The sound processor receives the signal and sends an amplified signal to a floating mass transducer 980 via leads 24. Transducer 980 is attached to the middle ear (e.g., the incus) to produce vibrations on the oval window the patient can detect.

In a preferred embodiment, the sound processor includes a rechargeable battery that is recharged with a pickup coil. The battery is recharged when a recharging coil having a current flowing through it is placed in close proximity to the pickup coil. Preferably, the volume of the sound processor may be remotely programmed such as being adjustable by magnetic switches which are set by placing a magnet in close proximity to the switches.

D. Surgery

Presently, patients with hearing losses above 50 dB are thought to be the best candidates for an implanted hearing device according to the present invention. Patients suffering from mild to mild-to-moderate hearing losses may, in the future, be found to be potential candidates. Extensive audiologic pre-operative testing is essential both to identify patients who would benefit from the device and to provide baseline data for comparison with post-operative results. In addition, such testing may allow identification of patients who could benefit from an additional procedure at the time that the device is surgically implanted.

Following identification of a potential recipient of the device, appropriate patient counseling should ensue. The goal of such counseling is for the surgeon and the audiologist to provide the patient with all of the information needed to make an informed decision regarding whether to opt for the device instead of conventional treatment. The ultimate decision as to whether a patient might substantially benefit from the invention should include account for both the patient's audiometric data and medical history and the patient's feelings regarding implantation of such a device. To assist in the decision, the patient should be informed of potential adverse effects, the most common of which is as light shift in residual hearing. More serious adverse effects include the potential for full or partial facial paralysis resulting from damage to the facial nerve during surgery. In addition, the inner ear may also be damaged during placement of the device. Although uncommon due to the use of biocompatible materials, immunologic rejection of the device could conceivably occur.

Prior to surgery, the surgeon needs to make several patient-management decisions. First, the type of anesthetic, either general or local, needs to be chosen; a local anesthetic enhances the opportunity for intra-operative testing of the device. Second, the particular transducer embodiment (e.g., attachment by an incus clip or a partial ossicular replacement prosthesis) that is best suited for the patient needs to be ascertained. However, other embodiments should be available during surgery in the event that an alternative embodiment is required.

One surgical procedure for implantation of the implantable portion of the device can be reduced to a seven-step process. First, a modified radical mastoidectomy is performed, whereby a channel is made through the temporal bone to allow for adequate viewing of the ossicles, without disrupting the ossicular chain. Second, a concave portion of the mastoid is shaped for the placement of the receiver coil. The middle ear is further prepared for the installation of the implant embodiment, if required; that is to say, other necessary surgical procedures may also be performed at this time. Third, the device (which comprises, as a unit, the transducer connected by leads to the receiving coil) is inserted through the surgically created channel into the middle ear. Fourth, the transducer is installed in the middle ear and the device is crimped or fitted into place, depending upon which transducer embodiment is utilized. As part of this step, the leads are placed in the channel. Fifth, the receiver coil is placed within the concave portion created in the mastoid. (See step two, above.) Sixth, after reviving the patient enough to provide responses to audiologic stimuli, the patient is tested intra-operatively following placement of the external amplification system over the implanted receiver coil. In the event that the patient fails the intra-operative tests or complains of poor sound quality, the surgeon must determine whether the device is correctly coupled and properly placed. Generally, unfavorable test results are due to poor installation, as the device requires a snug fit for optimum performance. If the device is determined to be non-operational, a new implant will have to be installed. Finally, antibiotics are administered to reduce the likelihood of infection, and the patient is closed.

Another surgical procedure for implantation of the implantable portion of the device is performed by simple surgical procedures. The person desiring the internal floating mass transducer is prepared for surgery with a local anesthetic as is common to most ear operations. The surgeon makes a post-auricular incision of 3–4 cm in length. The surgeon then pulls the ear (auricle) forward with a scalpel creating a channel along the posterior ear canal (EAC) between the surface of the bone and the overlying skin and fascia. The surgeon gingerly creates the channel (through which the leads will be placed) down the EAC until the annular ring of the tympanic membrane is reached. The annular ring is then dissected and folded back to expose the middle ear space. The floating mass transducer is directed through the surgically created channel into the middle ear space and attached to the appropriate middle ear structure. A speculum is advantageously used to facilitate this process. A concave basin is made in the temporal bone posterior to the auricle to hold the receiver coil in place or a small screw is set into the skull to keep the receiver coil from migrating over time. The transducer is then checked to see if it is working with a test where the subject is asked to simply judge sound quality of music and speech. If the test results are satisfactory, the patient is closed.

Post-operative treatment entails those procedures usually employed after similar types of surgery. Antibiotics and pain medications are prescribed in the same manner that they would be following any mastoid surgery, and normal activities that will not impede proper wound healing can be resumed within a 24–48 hour period after the operation. The patient should be seen 7–10 days following the operation in order to evaluate wound healing and remove stitches.

Following proper wound healing, fitting of the external amplification system and testing of the device is conducted by a dispensing audiologist. The audiologist adjusts the device based on the patient's subjective evaluation of that position which results in optimal sound perception. In addition, audiological testing should be performed without the external amplification system in place to determine if the surgical implantation affected the patient's residual hearing. A final test should be conducted following all adjustments in order to compare post-operative audiological data with the pre-operative baseline data.

The patient should be seen about thirty days later to measure the device's performance and to make any necessary adjustments. If the device performs significantly worse than during the earlier post-operative testing session, the patient's progress should be closely followed; surgical adjustment or replacement may be required if audiological results do not improve. In those patients where the device performs satisfactorily, semi-annual testing, that can eventually be reduced to annual testing, should be conducted.

VI. EXPERIMENTAL

The following examples serve to illustrate certain preferred embodiments and aspects of the present invention and are not to be construed as limiting the scope thereof. The experimental disclosure which follows is divided into: I) In Vivo Cadaver Examples; and II) In Vivo subjective Evaluation of Speech and Music. These two sections summarize the two approaches employed to obtain in vivo data for the device.

A. In Vivo Cadaver Examples

Figure 25:
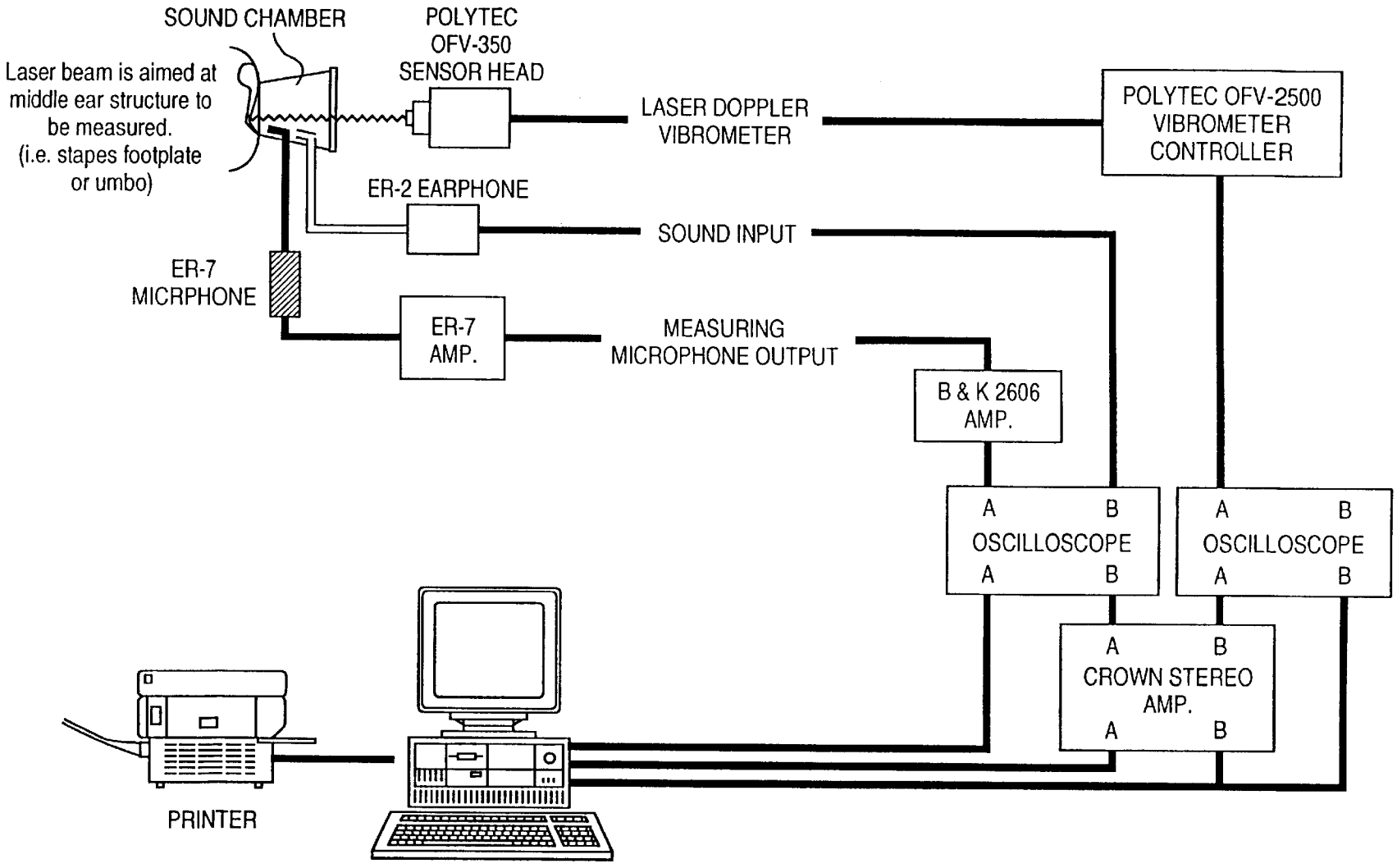
FIG. 25 is an illustration of the system that incorporates a laser Doppler velocimeter (LDV) to measure vibratory motion of the middle ear.
Figure 26:
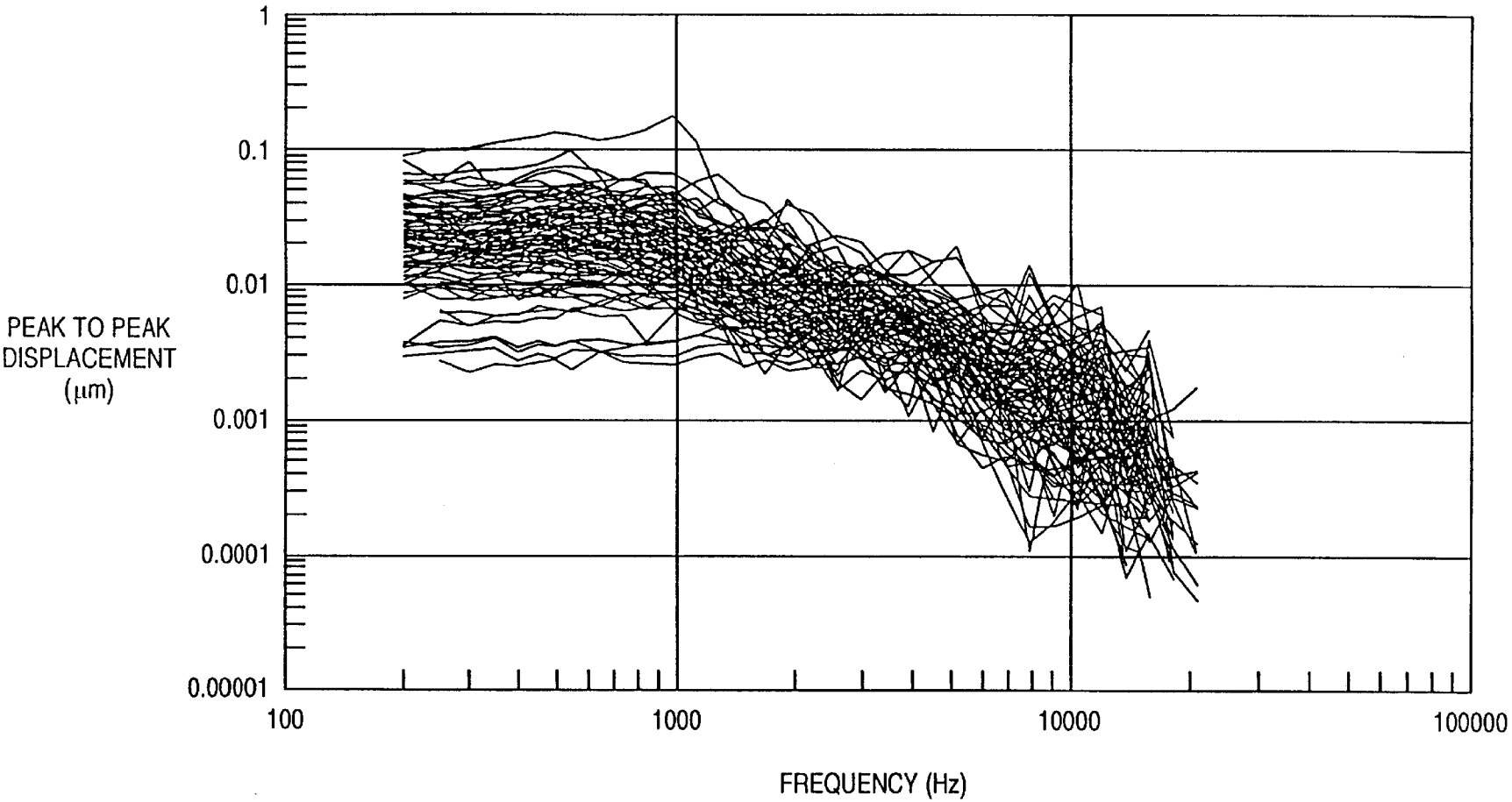
FIG. 26 depicts, by means of a frequency-response curve, the vibratory motion of the live human eardrum as a function of the frequency of sound waves delivered to it.

When sound waves strike the tympanic membrane, the middle ear structures vibrate in response to the intensity and frequency of the sound. In these examples, a laser Doppler velocimeter (LDV) was used to obtain curves of device performance versus pure tone sounds in human cadaver ears. The LDV tool that was used for these examples is located at the Veterans Administration Hospital in Palo Alto, Calif. The tool, illustrated by a block diagram in FIG. 25, has been used extensively for measuring middle ear vibratory motion and has been described by Goode et al. Goode et al. used a similar system to measure the vibratory motion of the live human eardrum in response to sound, the results of which are depicted in FIG. 26, in order to demonstrate the method's validity and to validate the cadaver temporal bone model.

In each of the three examples that follow, dissection of the human temporal bone included a facial recess approach in order to gain access to the middle ear. After removal of the facial nerve, a small target 0.5 mm by 0.5 mm square was placed on the stapes footplate; the target is required in order to facilitate light return to the LDV sensor head.

Sound was presented at 80 dB sound pressure level (SPL) at the eardrum in each example and measured with an ER-7 probe microphone 3 mm away from the eardrum. An ER-2 earphone delivered pure tones of 80 dB SPL in the audio range. The sound level was kept constant for all frequencies. The displacement of the stapes in response to the sound was measured by the LDV and recorded digitally by a computer which utilizes FFT (Fast Fourier Transform); the process has been automated by a commercially available software program (Tymptest), written for the applicant's lab, exclusively for testing human temporal bones.

In each example, the first curve of stapes vibration in response to sound served as a baseline for comparison with the results obtained with the device.

EXAMPLE 1

Transducer **4*b***

Figure 27:
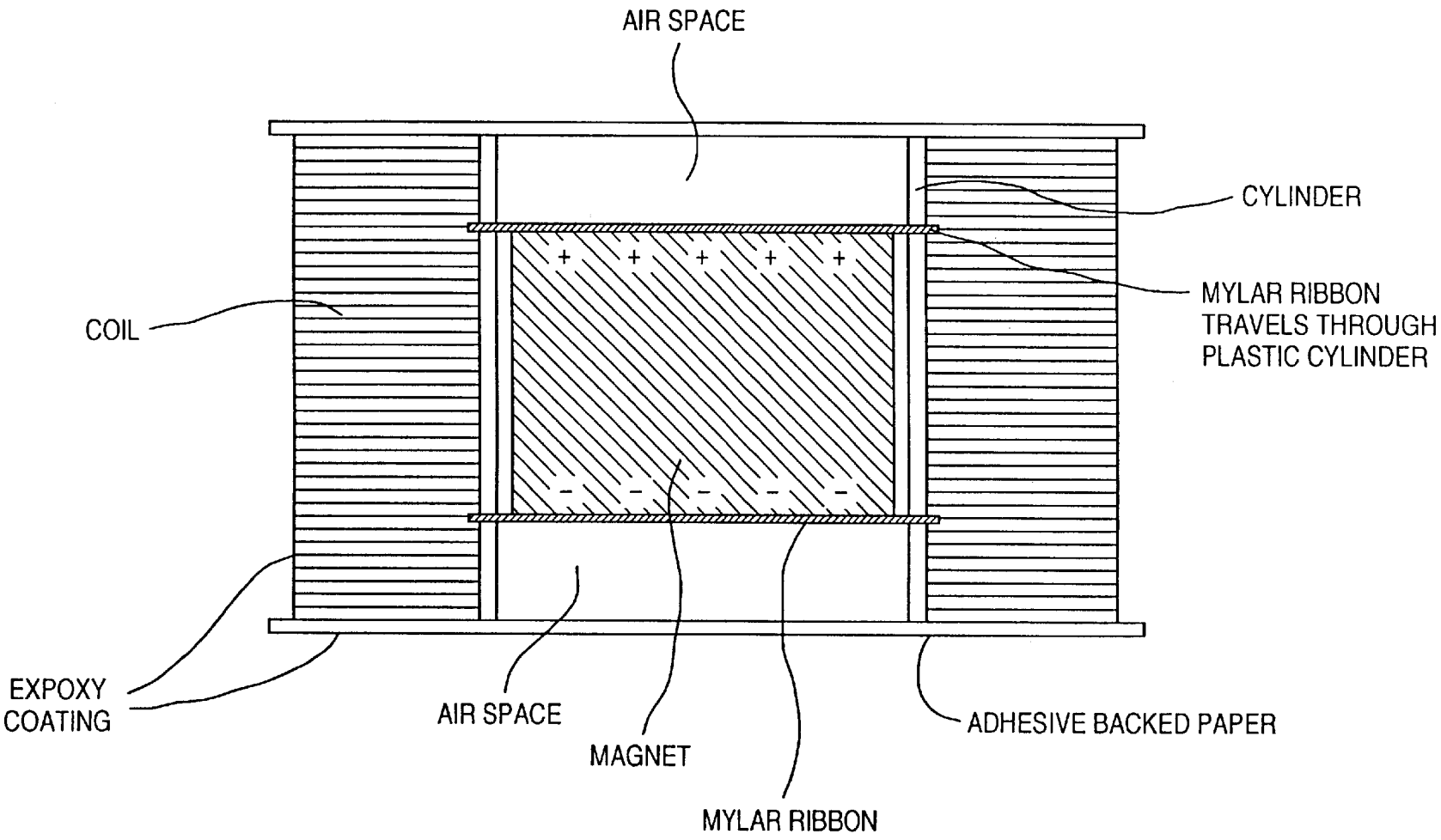
FIG. 27 is a cross-sectional view of a transducer (Transducer 4*b*) placed between the incus and the malleus during cadaver experimentation.

Transducer Construction: A 4.5 mm diameter by 2.5 mm length transducer, illustrated in FIG. 27, used a 2.5 mm diameter NdFeB magnet. A mylar membrane was glued to a 2 mm length by 3 mm diameter plastic drinking straw so that the magnet was inside the straw. The tension of the membrane was tested for what was expected to be the required tension in the system by palpating the structure with a toothpick. A 5 mm biopsy punch was used to punch holes into an adhesive backed piece of paper. One of the resulting paper backed adhesive disks was placed, adhesive side down, on each end of the assembly making sure the assembly was centered on the adhesive paper structure. A camel hair brush was used to carefully apply white acrylic paint to the entire outside surface of the bobbin-shaped structure. The painted bobbin was allowed to dry between multiple coats. This process strengthened the structure. Once the structure was completely dry, the bobbin was then carefully wrapped with a 44 gauge wire. After an adequate amount of wire was wrapped around the bobbin, the resulting coil was also painted with the acrylic paint in order to prevent the wire from spilling off the structure. Once dried, a thin coat of five minute epoxy was applied to the entire outside surface of the structure and allowed to dry. The resulting leads were then stripped and coated with solder (tinned).

Methodology: The transducer was placed between the incus and the malleus and moved into a "snug fit" position. The transducer was connected to the Crown amplifier output which was driven by the computer pure-tone output. The current was recorded across a 10 ohm resistor in series with Transducer **4*b***. With the transducer in place, the current to the transducer was set at 10 milliamps (mA) and the measured voltage across the transducer was 90 millivolts (mV); the values were constant throughout the audio frequency range although there was a slight variation in the high frequencies above 10 kHz. Pure tones were delivered to the transducer by the computer and the LDV measured the stapes velocity resulting from transducer excitation. The resulting figure was later converted into displacement for purposes of graphical illustration.

Figure 28:
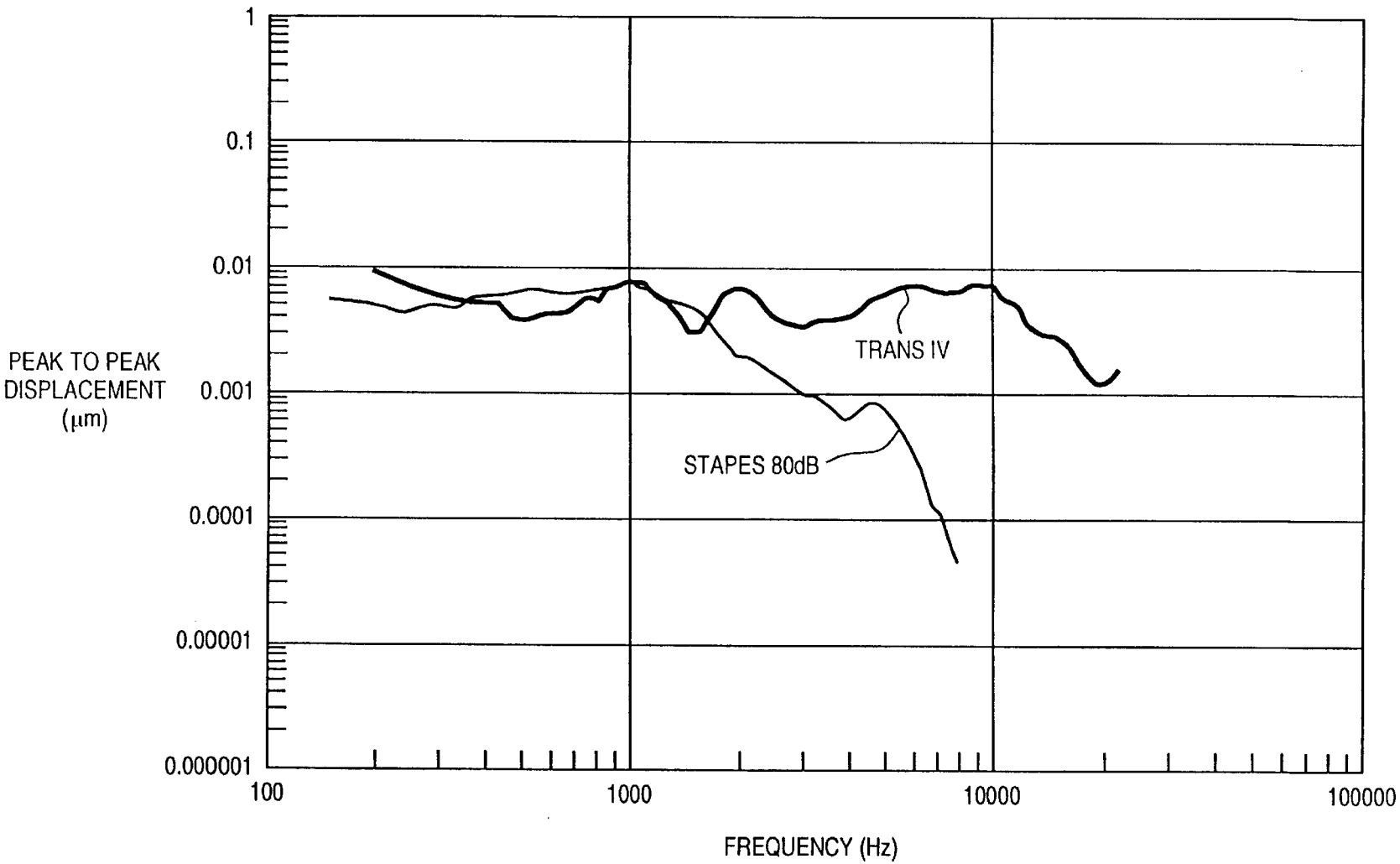
FIG. 28 illustrates through a frequency-response curve that the use of Transducer 4*b* resulted in gain in the high frequency range above 2 kHz.

Results: As FIG. 28 depicts, the transducer resulted in a gain in the frequencies above 2 kHz, but little improvement was observed in the frequencies below 2 kHz. The data marked a first successful attempt at manufacturing a transducer small enough to fit within the middle ear and demonstrated the device's potential for high fidelity-level performance. In addition, the transducer is designed to be attached to a single ossicle, not held in place by the tension between the incus and the malleus, as was required by the crude prototype used in this example. More advanced prototypes affixed to a single ossicle are expected to result in improved performance.

EXAMPLE 2

Transducer 5

Transducer Construction: A 3 mm length transducer (similar to Transducer **4*b*, FIG. 27) used a 2 mm diameter by 1 mm length NdFeB magnet. A mylar membrane was glued to a 1.8 mm length by 2.5 mm diameter plastic drinking straw so that the magnet was inside the straw. The remaining description of Transducer 5's construction is analogous to that of Transducer 4*b*** in Example 1, supra, except that: i) a 3 mm biopsy punch was used instead of a 5 mm biopsy punch; and ii) a 48 gauge, 3 litz wire was used to wrap the bobbin structure instead of a 44 gauge wire.

Methodology: The transducer was glued to the long process of the incus with cyanoacrylate glue. The transducer was connected to the Crown amplifier which was driven by the computer pure-tone output. The current was recorded across a 10 ohm resistor in series with Transducer 5. The current to the transducer was set at 3.3 mA, 4 mA, 11 mA, and 20 mA and the measured voltage across the transducer was 1.2 V, 1.3 V, 2.2 V, and 2.5 V, respectively; the values were constant throughout the audio frequency range although there was a slight variation in the high frequencies above 10 kHz. Pure tones were delivered to the transducer by the computer, while the LDV measured stapes velocity, which was subsequently converted to umbo displacement for graphical illustration.

Figure 29:
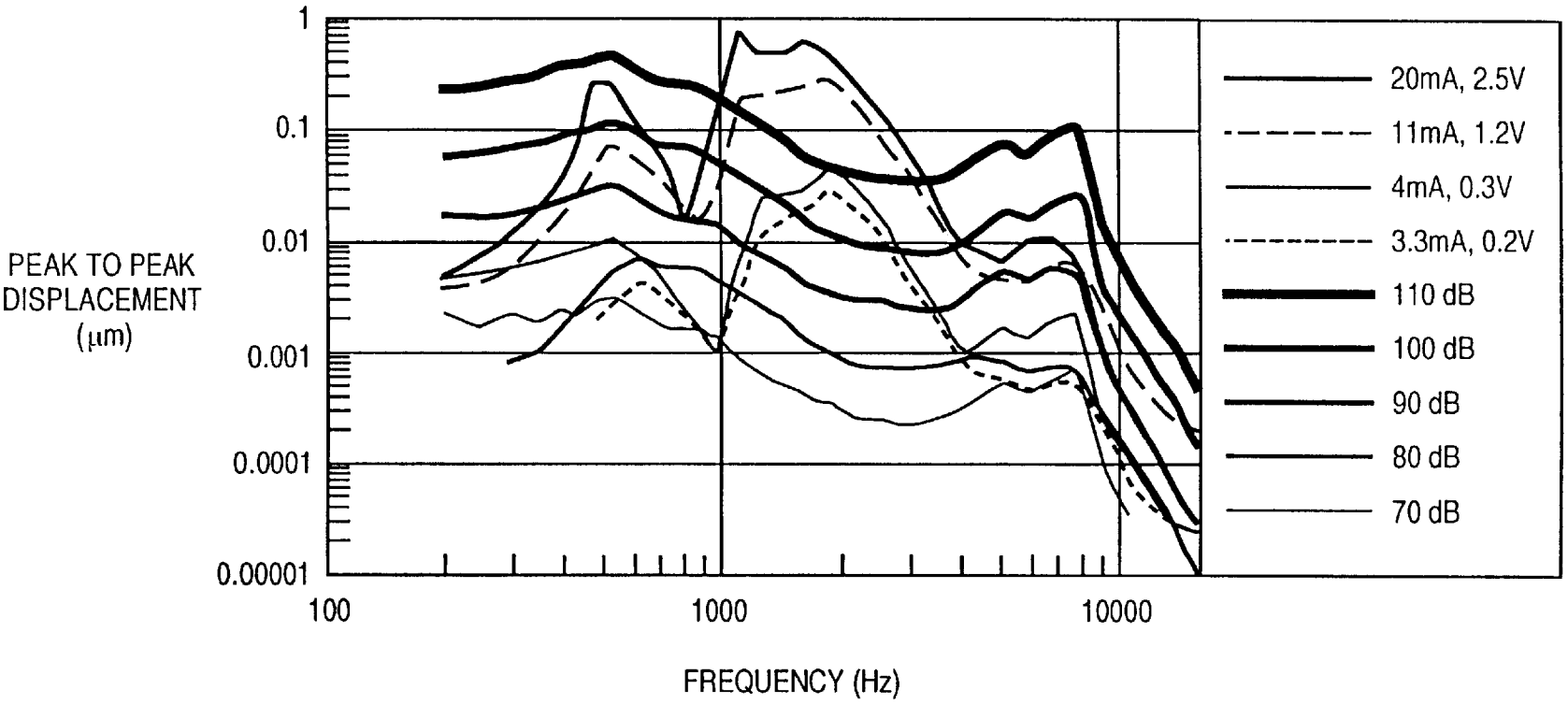
FIG. 29 illustrates through a frequency-response curve that the use of Transducer 5 resulted in marked improvement in the frequencies between 1 and 3.5 kHz with maximum output exceeding 120 dB SPL equivalents when compared with a baseline of stapes vibration when driven with sound.

Results: As FIG. 29 shows, Transducer 5, a much smaller transducer than Transducer **4*b***, demonstrated marked improvement in frequencies between 1 and 3.5 kHz, with maximum output exceeding 120 dB SPL equivalents when compared to stapes vibration when driven with sound.

EXAMPLE 3

Transducer 6

Transducer Construction: A 4 mm diameter by 1.6 mm length transducer used a 2 mm diameter by 1 mm length NdFeB magnet. A soft silicon gel material (instead of the mylar membrane used in Examples 1 and 2) held the magnet in position. The magnet was placed inside a 1.4 mm length by 2.5 mm diameter plastic drinking straw so that the magnet was inside the straw and the silicon gel material was gingerly applied to hold the magnet. The tension of the silicon gel was tested for what was expected to be the required tension in the system by palpating the structure with a toothpick. The remaining description of Transducer 6's construction is analogous to that of Transducer 4*b* in Example 1, supra, except that: 1) a 4 mm biopsy punch was used instead of a 5 mm biopsy punch; and ii) a 48 gauge, 3 litz wire was used to wrap the bobbin structure instead of a 44 gauge wire.

Methodology: The transducer was placed between the incus and the malleus and moved into a "snug fit" position. The transducer's leads were connected to the output of the Crown amplifier which was driven by the computer pure-tone output. The current was recorded across a 10 ohm precision resistor in series with Transducer 6. In this example, the current to the transducer was set at 0.033 mA, 0.2 mA, 1 mA, 5 mA and the measured voltage across the transducer was 0.83 mV, 5 mV, 25 mV, 125 mV, respectively; these values were constant throughout the audio frequency range although there was a slight variation in the frequencies above 10 kHz. Pure tones were delivered to the transducer by the computer, while the LDV measured the stapes velocity, which was subsequently converted to umbo displacement for graphical illustration.

Figure 30:
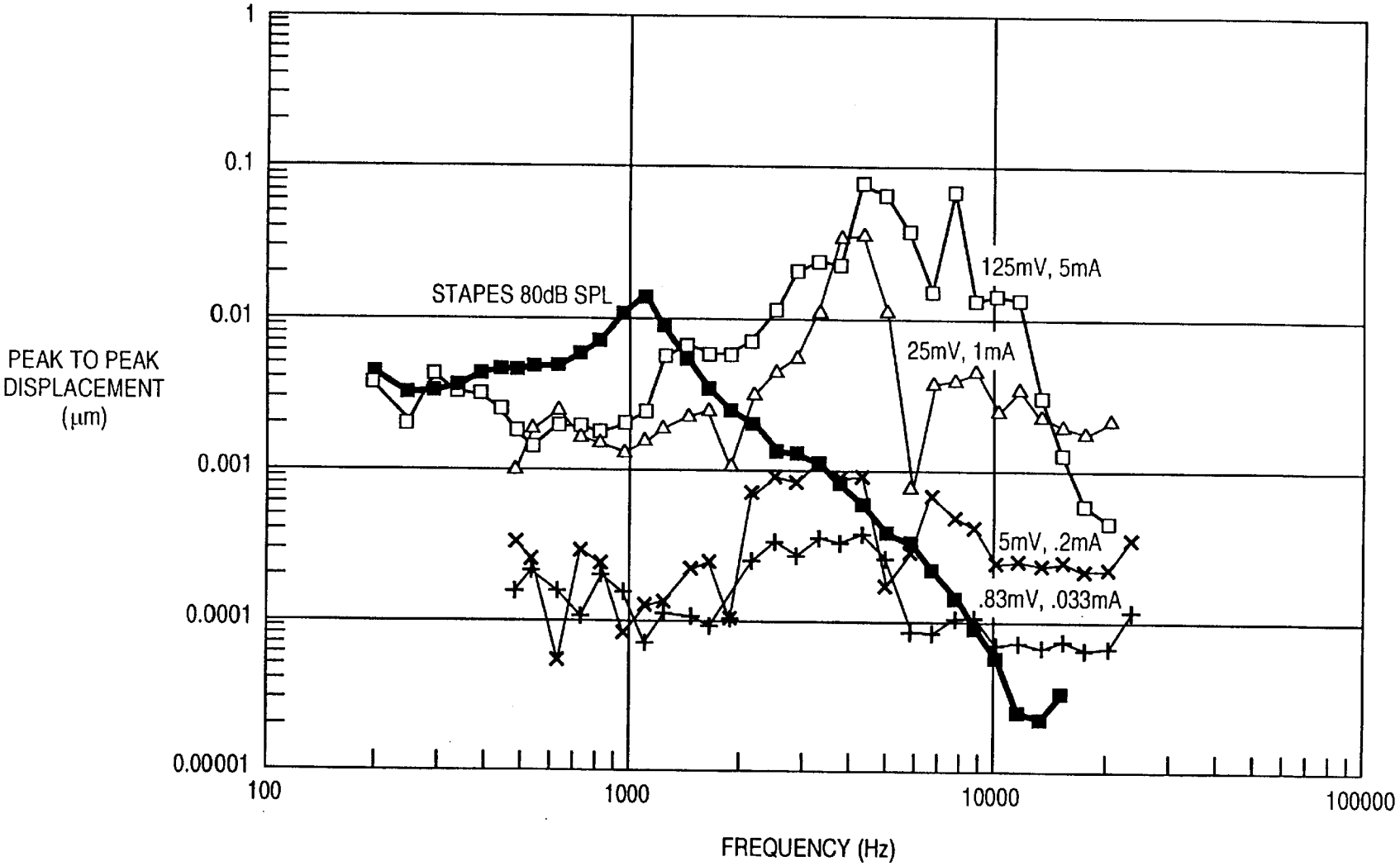
FIG. 30 illustrates through a frequency-response curve that the use of Transducer 6 resulted in marked improvement in the frequencies above 1.5 kHz with maximum output exceeding 120 dB SPL equivalents when compared with a baseline of stapes vibration when driven with sound.

Results: As FIG. 30 depicts, the transducer resulted in marked improvement in-the frequencies above 1.5 kHz, with maximum output exceeding 120 dB SPL equivalents when compared to the stapes vibration baseline driven with sound. The crude prototype demonstrated that the device's potential for significant sound improvement, in terms of gain, could be expected for those suffering from severe hearing impairment. As was stated in Example 1, the transducer is designed to be attached to a single ossicle, not held in place by the tension between the incus and the malleus, as was required by the prototype used in this example. More advanced prototypes affixed to a single ossicle are expected to result in improved performance.

B. In Vivo Subjective Evaluation of Speech and Music

This example, conducted on living human subjects, resulted in a subjective measure of transducer performance in the areas of sound quality for music and speech. Transducer 5, used in Example 2, supra, was used in this example.

EXAMPLE 4

Methodology: A soft silicon gel impression of a tympanic membrane, resembling a soft contact lens for the eye, was produced, and the transducer was glued to the concave surface of this impression. The transducer and the connected silicon impression were then placed on the subject's tympanic membrane by an otologic surgeon while looking down the subject's external ear canal with a Zeiss OPMI-1 stereo surgical microscope. The device was centered on the tympanic membrane with a non-magnetic suction tip and was held in place with mineral oil through surface tension between the silicon gel membrane and the tympanic membrane. After installation, the transducer's leads were taped against the skin posterior to the auricle in order to prevent dislocation of the device during testing. The transducer's leads were then connected to the Crown D-75 amplifier output. The input to the Crown amplifier was a common portable compact disk (CD) player. Two CDs were used, one featuring speech and the other featuring music. The CD was played and the output level of the transducer was controlled with the Crown amplifier by the subject. The subject was then asked to rate the sound quality of the device.

Results: The example was conducted on two subjects, one with normal hearing and one with a 70 dB "cookie-bite" sensory-neural hearing loss. Both subjects reported excellent sound quality for both speech and music; no distortion was noticed by either subject. In addition, the hearing-impaired subject indicated that the sound was better than the best hi-fidelity equipment that he had heard. One should recall that the transducer is not designed to be implanted in a silicon gel membrane attached to the subject's tympanic membrane. The method described was utilized because the crude transducer prototypes that were tested could never be used in a live human in implanted form, the method was the closest approximation to actually implanting a transducer, and the applicant needed to validate the results observed from the In Vivo Cadaver Examples with a subjective evaluation of sound quality.

VII. CONCLUSION

While the above is a complete description of the preferred embodiments of the invention, various alternatives, modifications and equivalents may be used. It should be evident that the present invention is equally applicable by making appropriate modifications to the embodiments described above. For example, a floating mass transducer may include magnetostrictive devices. Therefore, the above description should not be taken as limiting the scope of the invention which is defined by the metes and bounds of the appended claims.

What is claimed is:

1. An apparatus for improving hearing comprising:

a piezoelectric element having a first end and a second end, the first end being adapted to be coupled to a vibrating structure of the middle ear; and a mass coupled to a portion of the piezoelectric element, the mass vibrating in direct response to an externally generated signal to stimulate the vibrating structure of the middle ear.

2. An apparatus as in claim 1, wherein the piezoelectric element comprises a piezoelectric bimorph.

3. An apparatus as in claim 1, wherein the piezoelectric element comprises a plurality of piezoelectric strips.

4. An apparatus as in claim 1, wherein the piezoelectric element comprises a piezoelectric film layer.

5. An apparatus as in claim 1, wherein an electric signal is coupled to the piezoelectric element, the piezoelectric element vibrating in response to the signal.

6. An apparatus as in claim 1, wherein the piezoelectric element comprises a plurality of piezoelectric film layers.

7. An apparatus as in claim 1, wherein a mechanical vibration of the vibratory structure of the middle ear, vibrates the piezoelectric element to generate an electric signal.

8. An electromechanical transducer for use in an implantable hearing system, the transducer comprising:

a housing;

a first piezoelectric element having a first end and a second end, the first end coupled to the housing; and a first inertial mass coupled to the first piezoelectric element, the first inertial mass vibrating relative to the housing in response to an electrical signal to stimulate the vibrating structure of the human ear.

9. The transducer of claim 8, wherein the first piezoelectric element comprises a piezoelectric bimorph.

10. The transducer of claim 8, wherein the first piezoelectric element comprises a plurality of piezoelectric strips.

11. The transducer of claim 8, wherein the first piezoelectric element comprises a piezoelectric film.

12. The transducer of claim 8, further comprising:

a second piezoelectric element having a first end and a second end, the first end coupled to the housing; and a second inertial mass coupled to the second end of the second piezoelectric element, the second inertial mass vibrating relative to the housing in response to a second electric signal.

13. The transducer of claim 12, wherein the first and second piezoelectric elements have a substantially non-identical respective first and second mechanical vibration frequency responses to the respective first and second electrical signals.

14. The transducer of claim 12, wherein the first and second inertial masses have non-identical masses.

15. The transducer of claim 12, wherein the first inertial mass coupled to the first piezoelectric element has a different resonant characteristics then that of the second inertial mass coupled to the second piezoelectric element.

16. The transducer of claim 8, wherein an electrical signal is converted into a mechanical vibration adapted to be coupled to the vibratory structure.

17. The transducer of claim 8, wherein the housing provides a hermetically sealed capsule for the first piezoelectric element.

18. A totally implantable hearing aid system, comprising:

an implantable transducer, the transducer being adapted to receive sounds in the audiometric range of frequencies and to convert said sounds to an electric signal;

an implantable signal processing circuit, the signal processing circuit for modification of said electric signal; and an implantable inertial mass transducer comprising a housing and a mass mounted on the housing so as to vibrate relative to the housing in response to the modified electrical signal, the housing being adapted to be coupled to a portion of a human sensory system to stimulate the human sensory system in response to the mass vibrating relative to the housing.

19. The totally implantable hearing aid system of claim 18, further comprising a signal modulation circuit coupled to the signal processing circuit, the signal modulation circuit modulating the modified electric signal.

20. The totally implantable hearing aid system of claim 18, further comprising an amplifier circuit coupled between the transducer and the signal processing circuit, the amplifier circuit amplifying the electric signal.

21. The totally implantable hearing aid system of claim 18, further comprising an implantable power source.

22. The totally implantable hearing aid system of claim 21, wherein the power source is a rechargeable battery.

23. The totally implantable hearing aid system of claim 22, further comprising a charging device for supplying electrical power transcutaneously to the battery.

24. The totally implantable hearing aid system of claim 18, further comprising a remotely controlled electronics unit, the remotely controlled electronics unit for controlling the implantable signal processing unit.

25. The totally implantable hearing aid system of claim 18, wherein the implantable transducer comprises an electric microphone.

26. The totally implantable hearing aid system of claim 18, wherein the implantable inertial mass transducer comprises:

a piezoelectric element having a first end and a second end, the mass being coupled to an end of the piezoelectric element so that the piezoelectric element causes the mass to vibrate relative to the housing in response to the modified electrical signal.

27. The totally implantable hearing aid system of claim 18, wherein the housing is adapted to be coupled to a vibratory structure of the human ear taken from the group consisting of the tympanic membrane, ossicle, oval window, round window, and cochlea.

28. The totally implantable hearing aid system of claim 18, further comprising an implantable housing encompassing the transducer, the signal processing circuit, a signal modulation circuit, and a battery, the housing being composed of a biocompatable material.

* * * * *